US006822221B2

(12) United States Patent
Kumagai et al.

(10) Patent No.: US 6,822,221 B2
(45) Date of Patent: Nov. 23, 2004

(54) METHOD FOR LASER COOLING OF ATOMS AND APPARATUS THEREFORE

(75) Inventors: Hiroshi Kumagai, Wako (JP); Katsumi Midorikawa, Wako (JP)

(73) Assignee: Riken, Saitama (JP)

( * ) Notice: Subject to any disclaimer, the term of this patent is extended or adjusted under 35 U.S.C. 154(b) by 165 days.

(21) Appl. No.: 10/058,086

(22) Filed: Jan. 29, 2002

(65) Prior Publication Data

US 2002/0117612 A1 Aug. 29, 2002

(30) Foreign Application Priority Data

Jan. 29, 2001 (JP) ..... 2001-020243
Jan. 21, 2002 (JP) ..... 2002-011558

(51) Int. Cl.[7] ..... H05H 3/02
(52) U.S. Cl. ..... 250/251.1; 250/492.1
(58) Field of Search ..... 250/251, 492.1

(56) References Cited

U.S. PATENT DOCUMENTS 5,274,231 A * 12/1993 Chu et al. ..... 250/251
6,303,928 B1 * 10/2001 Buell et al. ..... 250/251
6,635,867 B2 * 10/2003 Kajita ..... 250/251
6,680,473 B2 * 1/2004 Ohmukai et al. ..... 250/251
6,684,645 B2 * 2/2004 Chu et al. ..... 62/3.1

OTHER PUBLICATIONS

Takeshi Fujii et al.; "Development of a high–power deep–ultravoilet continuous–wave coherent light source for laser cooling of silicon atoms"; Oct. 1, 2000/vol. 25, No. 19/Optics Letters.

* cited by examiner

*Primary Examiner*—Nikita Wells
*Assistant Examiner*—Erin-Michael Gill
(74) *Attorney, Agent, or Firm*—Birch, Stewart, Kolasch & Birch, LLP

(57) ABSTRACT

A method for cooling atoms, having a plurality of magnetic sublevels, involves a laser. Specifically, multiple polarized coherent light sources of a predetermined wavelength are sequentially emitted to atoms to move the electrons of the atoms to a lower magnetic sublevels, hence cooling the atoms. The sequentially emitted laser light can be applied at predetermined time intervals, whereby it becomes possible to laser-cool a variety of atoms including semiconductor atoms, such as silicon and germanium.

10 Claims, 24 Drawing Sheets

FORCE ACTS ON NEUTRAL ATOM (SCATTERING FORCE)

FIG. 2

STOP TIME

$$t = 2N\tau = 2 \cdot 11476 \cdot 5.524861878\text{ns} = 126.8\ \mu\text{s}$$

NATURAL WIDTH

$$\Delta\nu\ (=\gamma) = 1/(2\pi\tau) = 1/(2\text{x}3.141592654\text{x}5.52486\text{ns}) = 28.807054\text{MHz}$$

Doppler COOLING TEMPERATURE $kTD = h/(2\pi) \cdot \gamma = 6.6260755\text{x}10\text{-}34\ /2/\ 3.141592654/\ (2\text{x}3.141592654\text{x}5.52\text{ns}) = 220.227\mu\text{K}$

FIG. 3

Doppler WIDTH $\Delta\nu d = 2\nu 0 \quad ((2kB \quad T/Mc2) \quad \ln 2)1/2 \quad = 2 \cdot 1.18735651x1015 \cdot (2x1.380658x10\text{-}23xT/(27.976957 \cdot 1.6605402x10\text{-}27x2.99792458x108x2.99792458x108) \cdot \ln 2)1/2 = 160.7815759 \cdot T1/2$ MHz IN GASEOUS MOLECULE IN THERMAL EQUILIBRIUM, ATOMS EXHIBIT IRREGULAR Brownian MOVEMENT, EACH ATOM POSSESSES SLIGHTLY DIFFERENT RESONANCE FREQUENCY FROM ONE ANOTHER, AND POSSESSES NATURAL WIDTH IN EACH ATOM.

ACCORDINGLY, AS IN CASE OF GASEOUS MOLECULE,
ENVELOPE IN SPECTRAL DISTRIBUTION OF SPONTANEOUS EMISSION
REFLECTS ON DISPERSION IN CENTER FREQUENCY OF EACH ATOM.
SUCH BROADENING IS CALLED BY NAME OF INHOMOGENEOUS BROADENING.

Doppler WIDTH AT MELTING TEMPERATURE 6045.9MHz = 6.0459 GHz

FIG. 4(a)
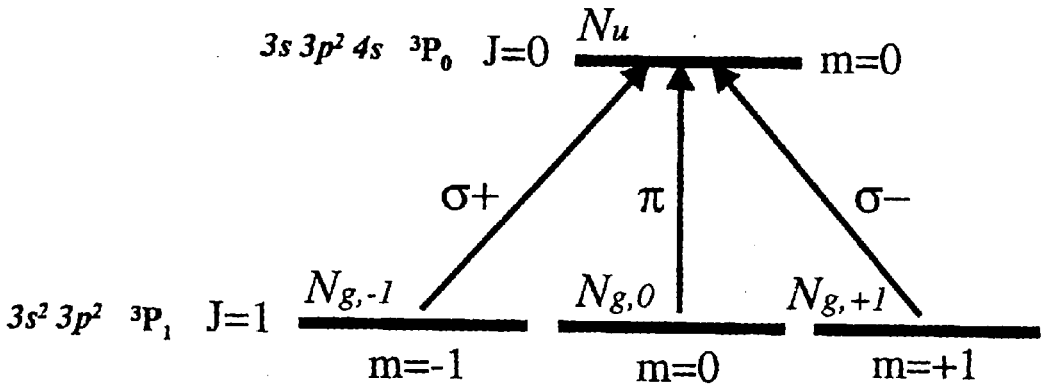
FIG. 4(b)
$$\frac{dNu}{dt} = W_{\sigma+} + W_{\pi} + W_{\sigma-} - \frac{Nu}{\tau}$$
$$\frac{dNg,_{-1}}{dt} = -W_{\sigma+} + \frac{Nu}{3\tau}$$
$$\frac{dNg,_{0}}{dt} = -W_{\pi} + \frac{Nu}{3\tau}$$
$$\frac{dNg,_{+1}}{dt} = -W_{\sigma-} + \frac{Nu}{3\tau}$$
FIG. 4(c)
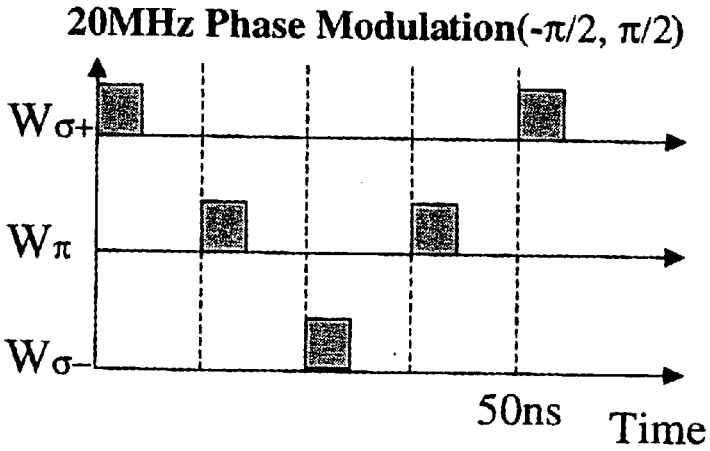

BIREFRINGENCE CRYSTAL $n_o$ : REFRACTIVE INDEX IN ORDINARY RAY $n_e$ : REFRACTIVE INDEX IN EXTRAORDINARY RAY

WHERE $n_o < n_e$ (PHASE DELAYS IN $n_e$-AXIS)

$$\Phi = 2\pi(n_o - n_e)\, d/\lambda$$

FIG. 7
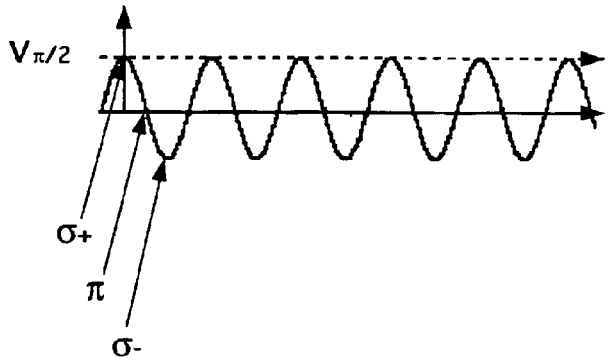
TIME REQUIRED FOR ABSORPTION – EMISSION OF ONE PHOTON : $2\tau=11\text{ns}$ ($\tau=5.5\text{ns}$)
↓
IT IS EFFICIENT WHEN NEXT PHOTON STRIKES AFTER 11 ns
PERIOD 11nsx4=44ns -> FREQUENCY IN PHASE MODULATOR fm< 22.7MHz
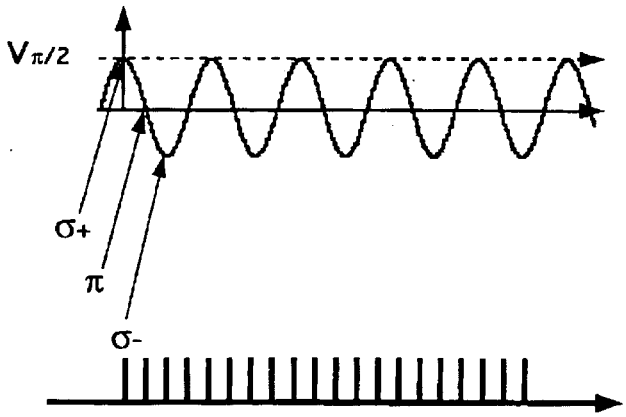
HIGH REPETITIVE LASER 4 fm

POLARIZED LIGHT CONTROL BY THREE COHERENT LIGHT SOURCE DEVICES

NO SIMULTANEOUS EMISSION

COHERENT EFFECT APPEARS SO THAT EFFICIENT COOLING CANNOT BE MADE

POLARIZED LIGHT CONTROL BY TWO COHERENT LIGHT SOURCE DEVICES

NO SIMULTANEOUS EMISSION

COHERENT EFFECT APPEARS SO THAT EFFICIENT COOLING CANNOT BE MADE

PICOSECOND COHERENT LIGHT SOURCE FOR SILICON DECELERATION: 252.4 nm WAVELENGTH

PICOSECOND COHERENT LIGHT SOURCE FOR SILICON DECELERATION: 252.4 nm WAVELENGTH

FIG. 14

CW COHERENT LIGHT SOURCE FOR SILICON DEGELERATION/COOLING TO WHICH POLARIZED LIGHT CONTROL FUNCTION HAS BEEN ADDED: 252.4 nm WAVELENGTH

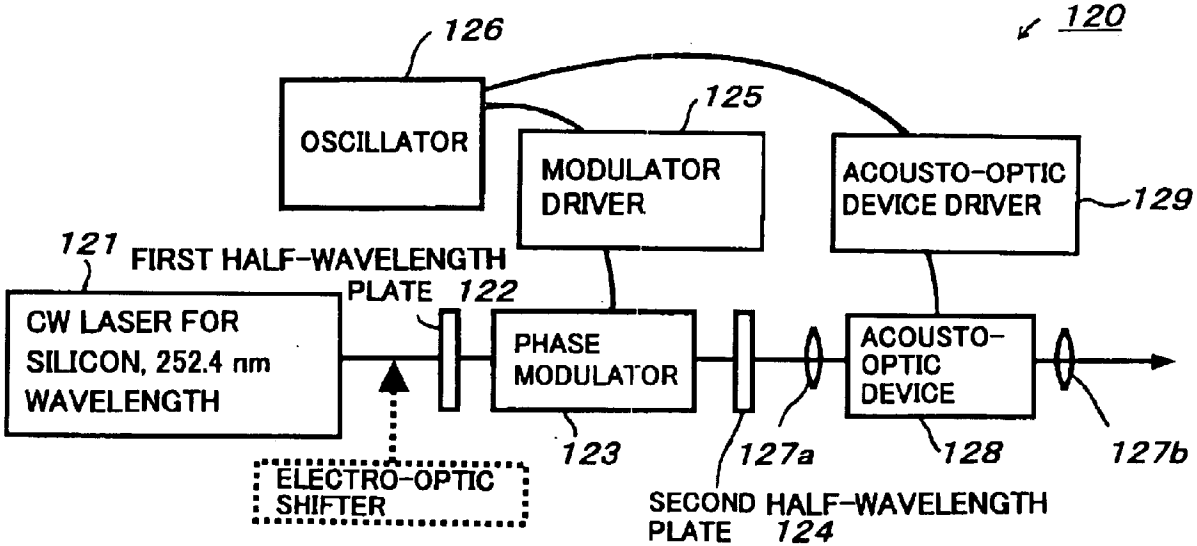

SILICON DECELERATION: FREQUENCY IS CHANGED TIME-VARYINGLY BY USE OF ACOUSTO-OPTIC DEVICE (CHIRPED COOLING)

SILICON COOLING: ACOUSTO-OPTIC DEVICE HAS EFFECT FOR SEPARATING POLARIZED LIGHT AND ADVANTAGEOUS FOR OPTIMIZING FREQUENCY

THERE IS CASE EFFECTIVE FOR CHIRPED COOLING BY INCREASING FREQUENCY SHIFT AMOUNT WITH ADDITION OF ELECTRO-OPTIC SHIFTER (EO SHIFTER)

PICOSECOND COHERENT LIGHT SOURCE FOR GERMANIUM DECELERATION: 271 nm WAVELENGTH 406.5 nm CORRESPOND TO SECOND HARMONICS OF 813 nm, AND 271 nm CORRESPOND TO THIRD HARMONICS OF 813 nm

PICOSECOND COHERENT LIGHT SOURCE FOR GERMANIUM DECELERATION: 271 nm WAVELENGTH 542 nm CORRESPOND TO SECOND HARMONICS OF 1084 nm, AND 271 nm CORRESPOND TO SECOND HARMONICS OF 542 nm

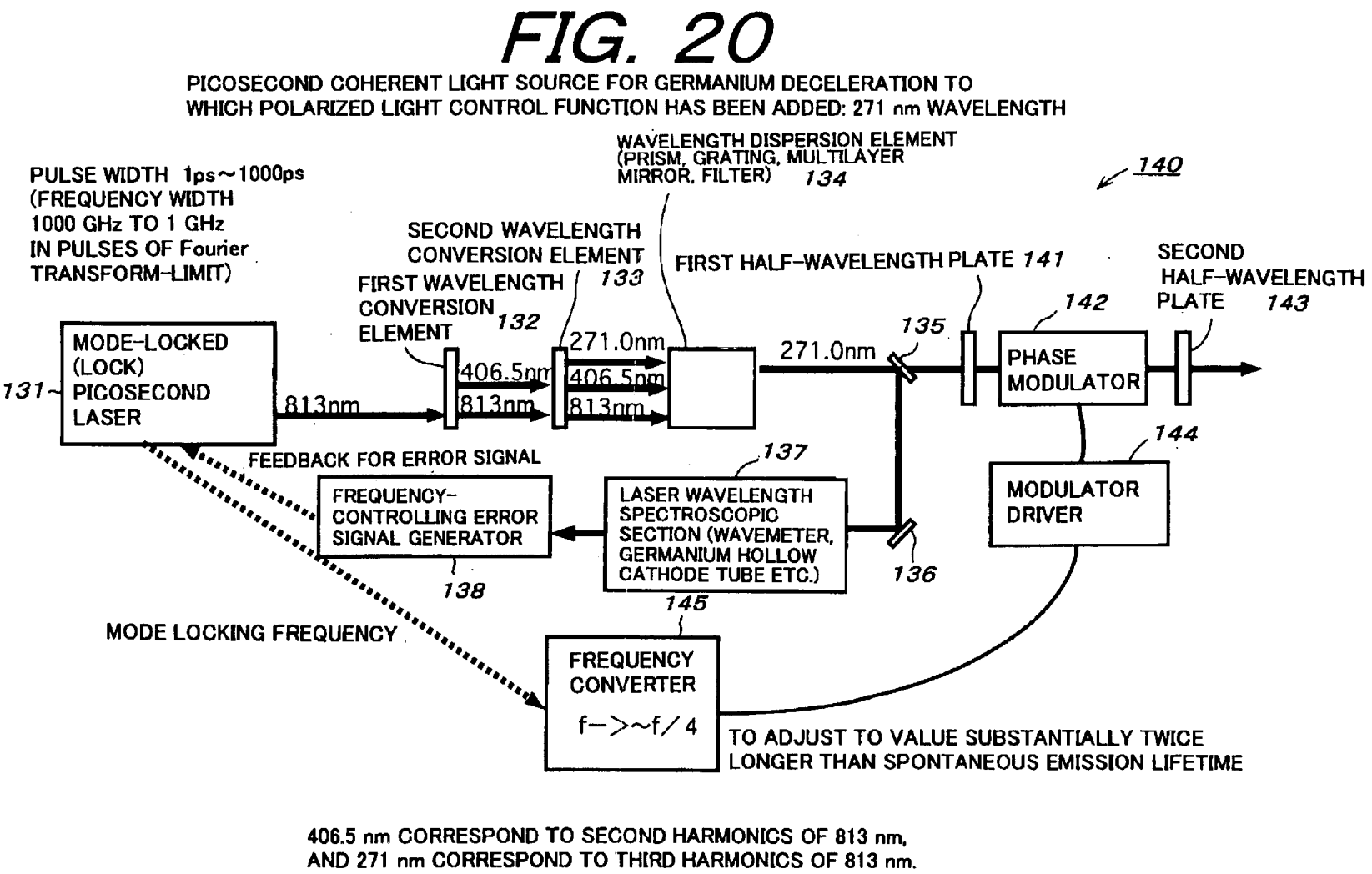
FIG. 20
PICOSECOND COHERENT LIGHT SOURCE FOR GERMANIUM DECELERATION TO WHICH POLARIZED LIGHT CONTROL FUNCTION HAS BEEN ADDED: 271 nm WAVELENGTH
140
PULSE WIDTH 1ps~1000ps (FREQUENCY WIDTH 1000 GHz TO 1 GHz IN PULSES OF Fourier TRANSFORM-LIMIT)
MODE-LOCKED (LOCK) PICOSECOND LASER
131
813nm
FIRST WAVELENGTH CONVERSION ELEMENT 132
406.5nm
813nm
SECOND WAVELENGTH CONVERSION ELEMENT 133
271.0nm
406.5nm
813nm
WAVELENGTH DISPERSION ELEMENT (PRISM, GRATING, MULTILAYER MIRROR, FILTER) 134
FIRST HALF-WAVELENGTH PLATE 141
271.0nm
135
136
PHASE MODULATOR 142
SECOND HALF-WAVELENGTH PLATE 143
MODULATOR DRIVER 144
LASER WAVELENGTH SPECTROSCOPIC SECTION (WAVEMETER, GERMANIUM HOLLOW CATHODE TUBE ETC.) 137
FREQUENCY-CONTROLLING ERROR SIGNAL GENERATOR 138
FEEDBACK FOR ERROR SIGNAL
FREQUENCY CONVERTER f->~f/4 145
TO ADJUST TO VALUE SUBSTANTIALLY TWICE LONGER THAN SPONTANEOUS EMISSION LIFETIME
MODE LOCKING FREQUENCY
406.5 nm CORRESPOND TO SECOND HARMONICS OF 813 nm, AND 271 nm CORRESPOND TO THIRD HARMONICS OF 813 nm.

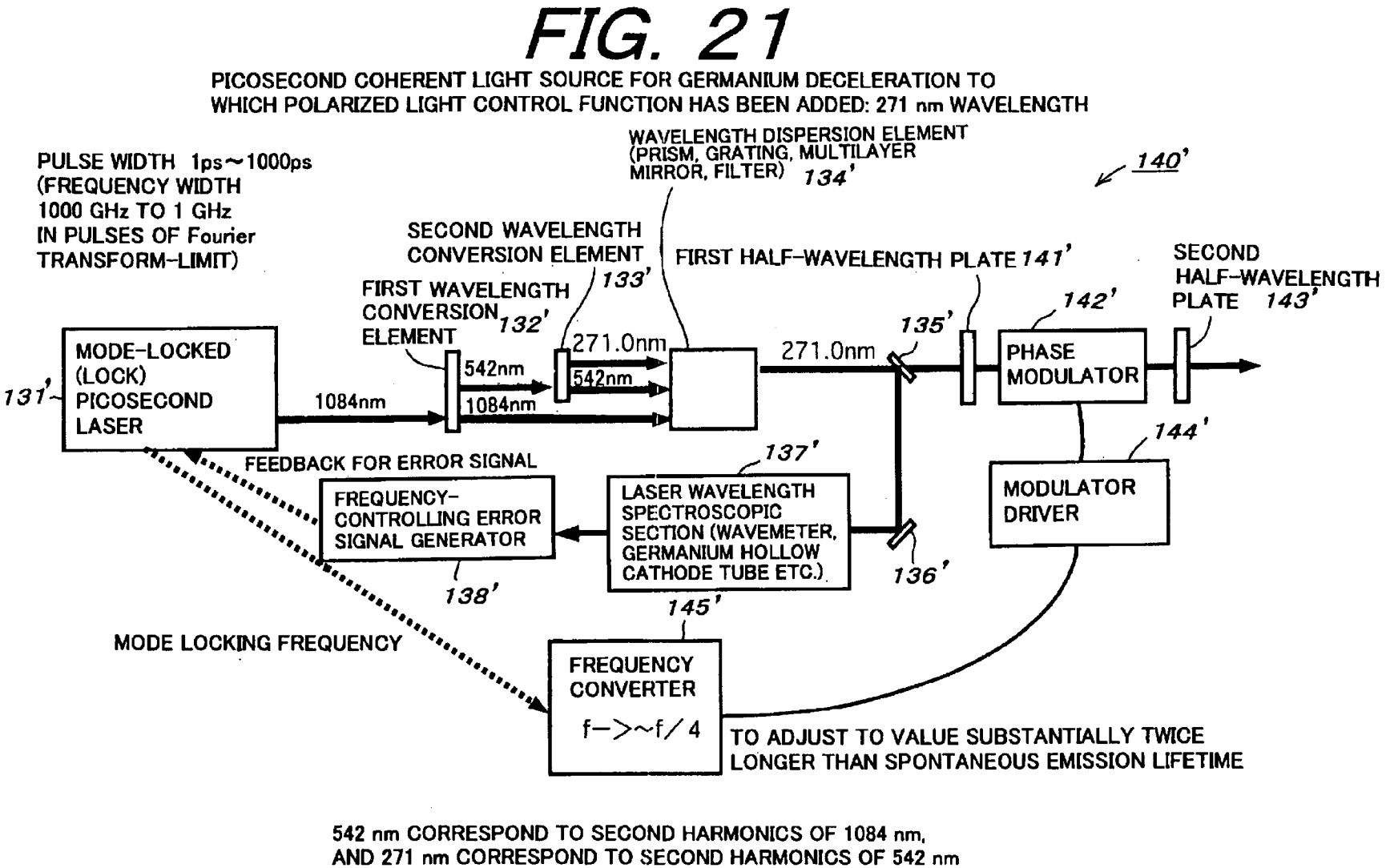
FIG. 21
PICOSECOND COHERENT LIGHT SOURCE FOR GERMANIUM DECELERATION TO WHICH POLARIZED LIGHT CONTROL FUNCTION HAS BEEN ADDED: 271 nm WAVELENGTH
140'
PULSE WIDTH 1ps~1000ps (FREQUENCY WIDTH 1000 GHz TO 1 GHz IN PULSES OF Fourier TRANSFORM-LIMIT)
MODE-LOCKED (LOCK) PICOSECOND LASER
131'
1084nm
FIRST WAVELENGTH CONVERSION ELEMENT 132'
542nm
1084nm
SECOND WAVELENGTH CONVERSION ELEMENT 133'
271.0nm
542nm
WAVELENGTH DISPERSION ELEMENT (PRISM, GRATING, MULTILAYER MIRROR, FILTER) 134'
271.0nm
135'
FIRST HALF-WAVELENGTH PLATE 141'
PHASE MODULATOR 142'
SECOND HALF-WAVELENGTH PLATE 143'
MODULATOR DRIVER 144'
136'
LASER WAVELENGTH SPECTROSCOPIC SECTION (WAVEMETER, GERMANIUM HOLLOW CATHODE TUBE ETC.) 137'
FREQUENCY-CONTROLLING ERROR SIGNAL GENERATOR 138'
FEEDBACK FOR ERROR SIGNAL
FREQUENCY CONVERTER f->~f/4 145'
TO ADJUST TO VALUE SUBSTANTIALLY TWICE LONGER THAN SPONTANEOUS EMISSION LIFETIME
MODE LOCKING FREQUENCY
542 nm CORRESPOND TO SECOND HARMONICS OF 1084 nm, AND 271 nm CORRESPOND TO SECOND HARMONICS OF 542 nm

FIG. 22

CW COHERENT LIGHT SOURCE FOR GERMANIUM DECELERATION/COOLING TO WHICH POLARIZED LIGHT CONTROL FUNCTION HAS BEEN ADDED: 271 nm WAVELENGTH

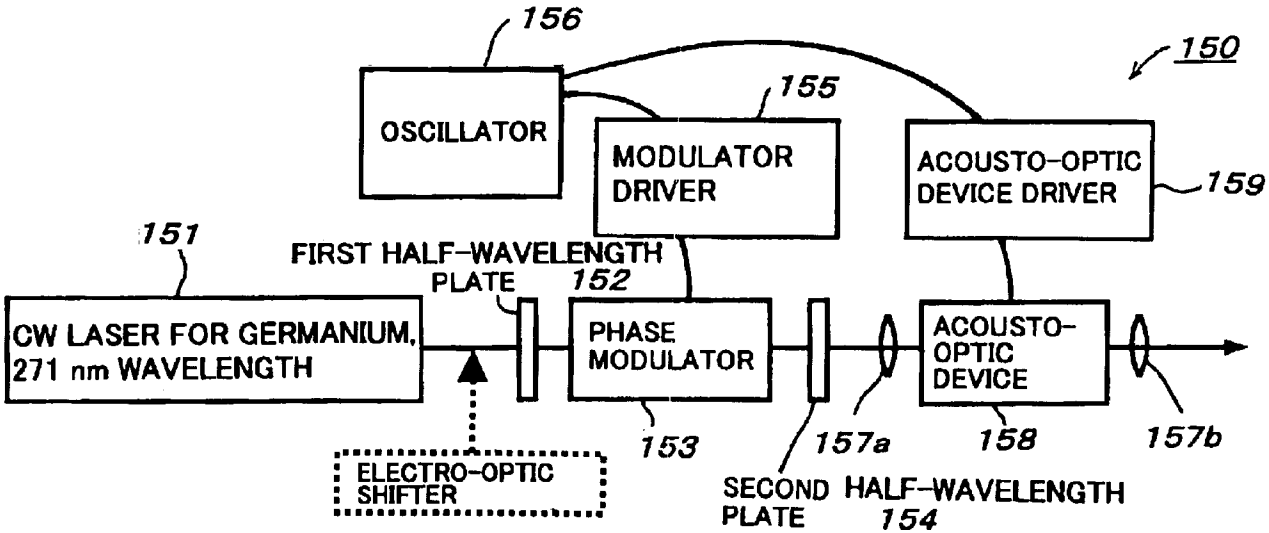

GERMANIUM DECELERATION: FREQUENCY IS CHANGED TIME-VARYINGLY BY USE OF ACOUSTO-OPTIC DEVICE (CHIRPED COOLING)

GERMANIUM COOLING: ACOUSTO-OPTIC DEVICE HAS EFFECT FOR SEPARATING POLARIZED LIGHT AND ADVANTAGEOUS FOR OPTIMIZING FREQUENCY

THERE IS CASE EFFECTIVE FOR CHIRPED COOLING BY INCREASING FREQUENCY SHIFT AMOUNT WITH ADDITION OF ELECTRO-OPTIC SHIFTER (EO SHIFTER)

METHOD FOR LASER COOLING OF ATOMS AND APPARATUS THEREFORE

BACKGROUND OF THE INVENTION

1. Field of the Invention

The present invention relates to a method for laser cooling of atoms and an apparatus therefore. More specifically, the present invention relates to a coherent light source for laser cooling atoms, and to a method for laser cooling a variety of atoms, such as silicon atoms and germanium atoms, each having a plurality of magnetic sublevels.

2. Description of the Related Art

In recent years, developments in the field of laser cooling of atoms has exhibited quantum leaps, starting with substantiation of Bose-Einstein's condensation and breakthroughs with atom lasers, nonlinear atom optics and the like.

In the laser cooling field, if it becomes possible to realize laser cooling of semiconductor atoms, such as silicon and germanium, instead of alkaline metal atoms and the like (which have been heretofore an object of laser cooling), novel developments can be expected from an engineering point of view. Hence, expansion in the possibilities of application are inestimable.

In these circumstances, there has been a strong need for provision of a technology for laser-cooling a variety of atoms, including semiconductor atoms, such as silicon and germanium.

OBJECTS AND SUMMARY OF THE INVENTION

The present invention has been made in view of the needs involved in the prior art as described above.

An object of the present invention is to provide a method for laser cooling of atoms by which it becomes possible to laser-cool a variety of atoms, including semiconductor atoms such as silicon and germanium, and an apparatus therefor as well as a coherent light source used in the apparatus.

In order to achieve the above-described objects, a method for laser cooling atoms and an apparatus therefor as well as a coherent light source used for laser cooling atoms are implemented in accordance with a manner as described hereinafter.

Laser cooling of atoms means herein a cooling method wherein the atoms collide against (are scattered with) a laser beam to repeat absorption and spontaneous emission of light, whereby kinetic energy of the atoms is released into such spontaneous emissions of light, whereby the atoms are cooled.

Such a process for laser cooling of atoms can be classified into a stage wherein atoms are sufficiently decelerated, and a stage wherein the atoms decelerated sufficiently are cooled. In such deceleration of atoms and cooling of atoms, a scattering force function occurs, as shown in FIG. 1.

In the following, "deceleration of atoms due to scattering force" and "cooling of atoms due to scattering force" will be described in detail.

First, cooling of atoms due to a scattering force will be described. The cooling of atoms due to a scattering force relates to so-called "Doppler cooling". Namely, Doppler shift acts most effectively with respect to cooling of atoms, which have been decelerated to around several times wider width than natural width.

In order to effect cooling of atoms by means of spontaneous emission, it is required that an average energy of photons emitted be higher than that of photons absorbed. Namely, Doppler cooling means to realize such a situation wherein an average energy of emitted photons is higher than that of absorbed photons. A particularly effective negative detuning amount is around a natural width (half width at half maximum) of resonance.

Incidentally, since a natural width (half width at half maximum) of silicon is around 28 MHz, a laser having a linewidth of the same degree as, or lower degree than, that of the natural width, i.e., around 28 MHz is required for Doppler cooling. Furthermore, such a laser takes about 130 microseconds until it reaches 220$\mu$ Kelvin which corresponds to the Doppler cooling temperature. Therefore, it is required to use a continuous wave (CW) light source.

It is to be noted that the natural width (half width at half maximum) of silicon, the Doppler cooling temperature, and the time (stop time) required for reaching 220$\mu$ Kelvin corresponding to the Doppler cooling temperature are determined by the mathematical expressions shown in FIG. 2.

Next, deceleration of atoms due to a scattering force will be described herein. In this case, a melting point of silicon is 1414° C., while a melting point of germanium is 958.5° C. The melting points of both of the materials are relatively high melting points, respectively.

A velocity of a silicon atom, which is ran off from the surface by means of electron-beam evaporation, exhibits a Boltzmann distribution centering on about 1000 m/s (meter per second). A half-value width thereof is wide, i.e., about 1500 m/s or more, so that it is about 6 GHz (gigahertz) in a resonance frequency region.

Namely, Doppler broadening (Doppler width) due to velocity broadening is about 6 GHz at melting temperature.

Accordingly, when a frequency of a single frequency coherent light source is changed with a lapse of time to effect chirped cooling in the case where the single frequency coherent light source is used, it becomes possible to decelerate atoms.

On one hand, it may be arranged to use a picosecond laser for decelerating atoms. Namely, in pulses of Fourier transform-limit, 100 picoseconds can involve a frequency zone of 10 GHz. In other words, when the picosecond laser is used, atomic beams, which are in Doppler velocity broadening, can be decelerated at the same time.

Doppler width is determined by the numerical expression shown in FIG. 3.

The reason why laser cooling of silicon atoms is difficult resides not only in that a cooling wavelength is short, but also in that energy level in a ground state, i.e., its cooling lower level being in a ground level involves a plurality of magnetic subsidiary levels, and specifically, three magnetic subsidiary levels.

More specifically, there are three magnetic subsidiary levels as its cooling lower level being a ground level in silicon atom, so that a magnetooptic trap cannot be prepared as in case of alkaline metal atom. This is a major cause of difficulty in laser cooling of silicon atoms.

Referring to FIGS. 4(*a*) and 4(*b*), a detailed explanation will be further continued. In silicon atom, a magnetic quantum number m is degenerated in three magnetic subsidiary levels "m=−1", "m=0", and "m=+1" in energy level in a ground state, i.e., its cooling lower level ($3s^2p^2\ {}^3P_1$, J=1) being the ground level.

In order to laser-cool silicon atoms, it is required that laser beams are emitted to the silicon atoms to excite them, whereby their energy level is elevated from their cooling lower level in their ground state to their cooling upper level ($3\ s3\ p^2 4s^3P_0$, J=0) being their excitation level.

As a result, the silicon atoms are excited by means of emission of laser beams, whereby they are elevated to the cooling upper level. However, such silicon atoms excited from the cooling lower level to the cooling upper level return again to the cooling lower level after expiring spontaneous emission lifetime.

In this case, silicon atoms in the cooling upper level return equivalently to three magnetic subsidiary levels "m=−1", "m=0", and "m=+1" with one third each of them in the case where the silicon atoms return from the cooling upper level to the cooling lower level (a solution is obtained from the simultaneous differential equations shown in FIG. 4(*b*).).

On one hand, silicon atoms in the magnetic subsidiary level of "m=−1" being its cooling lower level in a ground state are excited to its cooling upper level when laser beams of right-handed polarized light (σ+) were emitted to such silicon atoms, silicon atoms in the magnetic subsidiary level of "m=0" being its cooling lower level in a ground state are excited to its cooling upper level when laser beams of linearly polarized light (n) were emitted to such silicon atoms, and silicon atoms in the magnetic subsidiary level of "m=+1" being its cooling lower level in a ground state are excited to its cooling upper level when laser beams of left-handed polarized light (σ−) were emitted to such silicon atoms.

Accordingly, when it is intended to implement laser cooling of silicon atoms by emitting, for example, linearly polarized light, only the silicon atoms in the magnetic subsidiary level "m=0" among cooling lower levels being in a ground state are excited to its cooling upper level. Then, the silicon atoms thus excited to the cooling upper level return to the magnetic subsidiary levels after expiring spontaneous emission lifetime wherein only one third of the silicon atoms return to the magnetic subsidiary level of "m=0" among cooling lower levels being in a ground state. Hence, silicon atoms, which are to be excited from their cooling lower level being in their ground state to their cooling upper level, decrease gradually, so that a magneto-optic trap as in a case of alkaline metal atoms could not have been prepared.

Likewise, since there is a plurality of magnetic subsidiary levels in also germanium atom as its cooling lower level, laser cooling of germanium atoms was difficult.

For the sake of overcoming such difficulty as described above, a method for laser cooling of atoms according to the present,invention is arranged such that in case of laser-cooling the atoms each involving a plurality of magnetic subsidiary levels as its cooling lower level, each laser beam having a plurality of polarized light in response to the plurality of magnetic subsidiary levels being its cooling lower level in a ground state is emitted sequentially to the atoms with a predetermined time interval. In other words, the method is to control time-varyingly polarized light in a laser beam by emitting repeatedly such laser beam involving different polarized light in order in each predetermined period of time.

In the case where a laser beam involving different polarized light is emitted repeatedly in order in each predetermined period of time, it is arranged such that photons are struck on an atom successively with a time interval corresponding to twice longer than a spontaneous emission lifetime of the atom, i.e., which is a time required for absorption—emission of one photon, whereby an atom being in its cooling lower level in a ground state can be excited efficiently to its cooling upper level.

Accordingly, a method for laser cooling atoms each involving a plurality of magnetic subsidiary levels as its cooling lower level being in a ground state in energy level of the present invention comprises emitting sequentially each coherent light of a predetermined wavelength containing a plurality of different polarized light to the atoms in response to the plurality of magnetic subsidiary levels being the cooling lower level in the ground state in an atom, which is an object to be laser-cooled, while keeping a predetermined time interval.

Furthermore, the method for laser cooling of atoms described in the above invention wherein the predetermined time interval is that substantially twice longer than spontaneous emission lifetime of the atom corresponding to a time required for absorption—emission of one photon.

Moreover, an apparatus for laser cooling of atoms for laser-cooling atoms each involving a plurality of magnetic subsidiary levels as its cooling lower level being in a ground state in energy level according to the present invention comprises a coherent light source for producing a coherent light having a predetermined wavelength; a polarized light control means for controlling polarized light of the coherent light output from the coherent light source to emit the coherent light of different polarized light to the atom with a predetermined time interval; and the polarized light of the coherent light emitted from the polarized light control means corresponds respectively to the plurality of different polarized light in response to the plurality of magnetic subsidiary levels being the cooling lower level in the ground state of an atom, which is an object to be laser-cooled.

Sill further, an apparatus for laser cooling of atoms for laser-cooling atoms each involving a plurality of magnetic subsidiary levels as its cooling lower level being in a ground state in energy level according to the present invention comprises a plurality of coherent light sources outputting respectively a coherent light of a predetermined wavelength involving respectively a plurality of different polarized light in response to the plurality of magnetic subsidiary levels being the cooling lower level in the ground state of an atom, which is an object to be cooled; each coherent light of the predetermined wavelength containing the plurality of different polarized light output from the plurality of coherent light sources being sequentially emitted to the atom while keeping a predetermined time interval; and the polarized light of the coherent light emitted from the plurality of coherent light sources corresponding respectively to the plurality of different polarized light in response to the plurality of magnetic subsidiary levels being the cooling lower level in the ground state of the atom, which is the object to be laser-cooled.

The apparatus for laser cooling of atoms described in the above invention wherein at least one of the plurality of coherent light sources is that outputs selectively coherent light involving two different polarized light.

Further, the apparatus for laser cooling of atoms described in the above invention wherein the predetermined time interval is that substantially twice longer than spontaneous emission lifetime of the atom corresponding to a time required for absorption—emission of one photon.

In addition, a coherent light source used for laser cooling of atoms according to the present invention comprises a mode-locked (lock) picosecond laser for outputting coherent light of a predetermined wavelength; a wavelength conversion element for converting a wavelength of the coherent light of the predetermined wavelength output from the mode-locked (lock) picosecond laser; a wavelength dispersion element for selecting coherent light of a desired wavelength from the coherent light, which has been subjected to wavelength conversion by means of the wavelength conversion element, to output the coherent light selected; and a feedback circuit for measuring a wavelength of the coherent light output from the wavelength dispersion element to output a signal to the mode-locked (lock) picosecond laser in such that the mode-locked (lock) picosecond laser outputs coherent light of a predetermined wavelength on the basis of the measured result.

Yet further, an apparatus for laser cooling of atoms for laser-cooling atoms each involving a plurality of magnetic subsidiary levels as its cooling lower level being in a ground state in energy level according to the present invention comprises a coherent light source producing coherent light of predetermined wavelength; a polarized light control means including a half-wavelength plate and an acousto-optic device, and controlling polarized light obtained from the coherent light output from the coherent light source by means of the half-wavelength plate to emit coherent light involving different polarized light to the atoms with a predetermined time interval; and chirped cooling being effected by changing time-varyingly a frequency by the use of the acousto-optic device to decelerate the atoms as well as to separate time-varyingly the polarized light obtained by means of the half-wavelength plate with the use of the acousto-optic device, besides to optimize the frequency thereby cooling the atoms by means of scattering force.

Furthermore, a coherent light source used for laser cooling of atoms according to the present invention comprises a first laser beam producing system for producing laser beam of a first wavelength; and a second laser beam producing system for producing laser beam of a second wavelength as well as for introducing the laser beam of the first wavelength produced in the first laser beam producing system thereinto to produce laser beam of a third wavelength as a result of sum frequency mixing of the laser beam of the first wavelength and the laser beam of the second wavelength.

Moreover, an apparatus for laser cooling of atoms for laser-cooling atoms each involving a plurality of magnetic subsidiary levels as its cooling lower level being in a ground state in energy level according to the present invention comprises a coherent light source including a first laser beam producing system for producing laser beam of a first wavelength, and a second laser beam producing system for producing laser beam of a second wavelength as well as for introducing the laser beam of the first wavelength produced in the first laser beam producing system thereinto to produce laser beam of a third wavelength as a result of sum frequency mixing of the laser beam of the first wavelength and the laser beam of the second wavelength; a polarized light control means including a half-wavelength plate and an acousto-optic device, and controlling polarized light obtained from the coherent light output from the coherent light source by means of the half-wavelength plate to emit coherent light involving different polarized light to the atoms with a predetermined time interval; and chirped cooling being effected by changing time-varyingly a frequency by the use of the acousto-optic device to decelerate the atoms as well as to separate time-varyingly the polarized light obtained by means of the half-wavelength plate with the use of the acousto-optic device, besides to optimize the frequency thereby cooling the atoms by means of scattering force.

BRIEF DESCRIPTION OF THE DRAWINGS

The present invention will become more fully understood from the detailed description given hereinafter and the accompanying drawings which are given by way of illustration only, and thus are not limitative of the present invention, and wherein:

FIG. 2 is a diagram showing numerical expressions for determining a natural width (half width at half maximum) of silicon, Doppler cooling temperature, and a time required for reaching 220$\mu$ Kelvin, which is a Doppler cooling temperature (stop time);

FIG. 3 is a diagram showing a numerical expression for determining a Doppler width;

FIGS. 4(*a*), 4(*b*), and 4(*c*) are explanatory views wherein FIG. 4(*a*) shows energy levels, FIG. 4(*b*) shows simultaneous differential equations for determining the number of silicon atoms existing in respective energy levels, and FIG. 4(*c*) is a timing chart indicating a timing for emitting each coherent light of respective types of polarized light;

FIG. 7 is an explanatory diagram showing that a time required for absorption—emission of one photon is two times longer than a spontaneous emission lifetime ($\tau$);

FIG. 14 is an explanatory diagram showing an example of the preferred embodiment of a laser cooling apparatus wherein one CW laser of 252.4 nm wavelength (a CW coherent light source used for deceleration/cooling of silicon to which a function for controlling polarized light has been added) is used as a coherent light source for cooling atoms;

FIG. 20 is an explanatory diagram showing an example of a further preferred embodiment of a laser cooling apparatus according to the present invention wherein one of the picosecond coherent light sources each used for deceleration of germanium shown in FIG. 18 (a picosecond coherent light source used for deceleration of germanium to which a function for controlling polarized light has been added) is used as a coherent light source for laser cooling of atoms;

FIG. 21 is an explanatory diagram showing an example of the further preferred embodiment of a laser cooling apparatus according to the present invention wherein one of the picosecond coherent light sources each used for deceleration of germanium shown in FIG. 19 (a picosecond coherent light source used for deceleration of germanium to which a function for controlling polarized light has been added) is used as a coherent light source for laser cooling of atoms; and FIG. 22 is an explanatory diagram showing an example of the further preferred embodiment of a laser cooling apparatus wherein one CW laser of 271 nm wavelength (a CW coherent light source used for deceleration/cooling of germanium to which a function for controlling polarized light has been added) is used as a coherent light source for cooling atoms.

DETAILED DESCRIPTION OF THE PREFERRED EMBODIMENTS

In the following, an example of each preferred embodiment of a method for laser cooling of atoms and an apparatus therefor as well as a coherent light source used for laser cooling of atoms according to the present invention will be described in detail by referring to the accompanying drawings.

Figure 1:
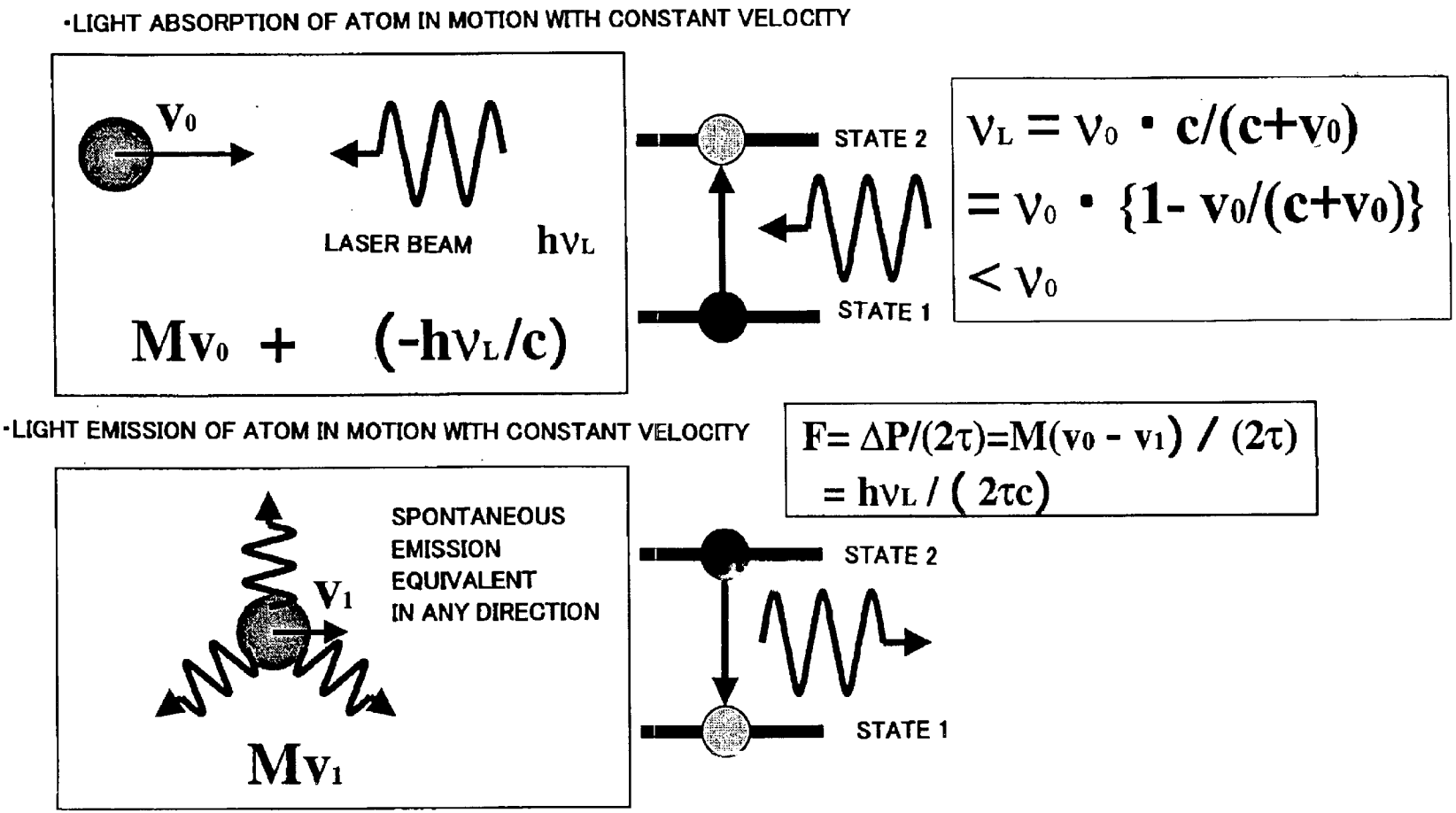
FIG. 1 is a diagram for explaining a force (scattering force) acting upon a neutral atom.
Figure 5:
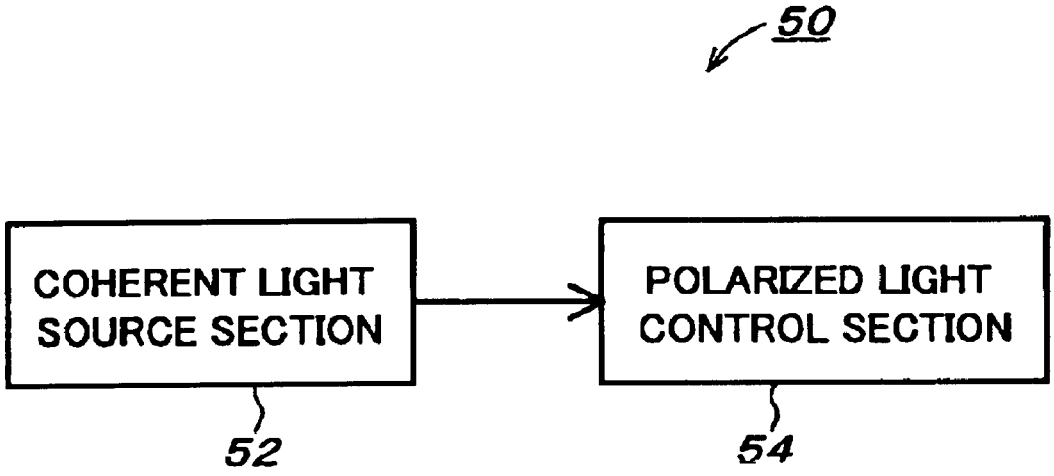
FIG. 5 is an explanatory block diagram showing an example of a preferred embodiment of an apparatus for laser cooling of atoms according to the present invention.

FIG. 5 is an explanatory block diagram for a conceptual constitution showing an example of a preferred embodiment of an apparatus for laser cooling of atoms according to the present invention. The laser cooling apparatus according to the present invention shown in FIG. 5 may be used to cool a variety of atoms, such as silicon atoms, and germanium atoms.

Namely, the laser cooling apparatus 50 according to the invention is composed of a coherent light source section 52 for producing coherent light having a predetermined wavelength and outputting it, and a polarized light control section 54 for changing polarized light of the coherent light output from the coherent light source 52.

The coherent light source section 52 of the laser cooling apparatus 50 according to the invention may be constituted in, for example, a two-stage external resonator type wavelength converting section for producing laser beams having a predetermined wavelength as coherent light and outputting the same. On the other hand, the polarized control section 54 of the laser cooling apparatus 50 according to the invention may be constituted in, for example, a phase modulator obtained by combining an electro-optic device constituted by a birefringent crystal, which can control time-varyingly polarization, with a wavelength plate. It is to be noted that the electro-optic device means a material wherein its refractive index is changed by an electric field applied to the birefringent crystal thereby to change a phase of the laser beams passing through there.

A case where silicon atoms are cooled by the use of the laser cooling apparatus 50 of the present invention will be described hereinafter wherein the above-described two-stage external resonator type wavelength converting section is used as the coherent light source section 52, and the above-described phase modulator is used as the polarized light control section 54. In this case, a laser beam having a 746 nm wavelength (for example, a ring type single-mode titanium sapphire laser beam of Nd:$YVO_4$ second harmonics excitation having 746 nm wavelength may be used) is introduced in the external resonator in a first stage of the external resonator type wavelength converting section being the coherent light source 52, whereby second harmonics having 373 nm wavelength are allowed to produce by means of an LBO crystal disposed in the resonator at 40% conversion efficiency.

Successively, the laser beam of 373 nm wavelength and laser beam having 780 nm wavelength (for example, single-mode semiconductor laser beam having 780 nm wavelength may be used) are introduced in a second resonator in a second stage of the external resonator type converting section, and the laser beams containing two wavelengths are resonated simultaneously to increase respective optical powers, whereby a light beam of 252 nm, which exceeds 60 mW, is produced as a result of sum frequency mixing by means of a BBO crystal in the resonator.

In the polarized control section 54, a phase modulator is composed by combining an electro-optic device prepared from a birefringent crystal with a wavelength plate, whereby polarization is controlled time-varyingly.

Figure 6:
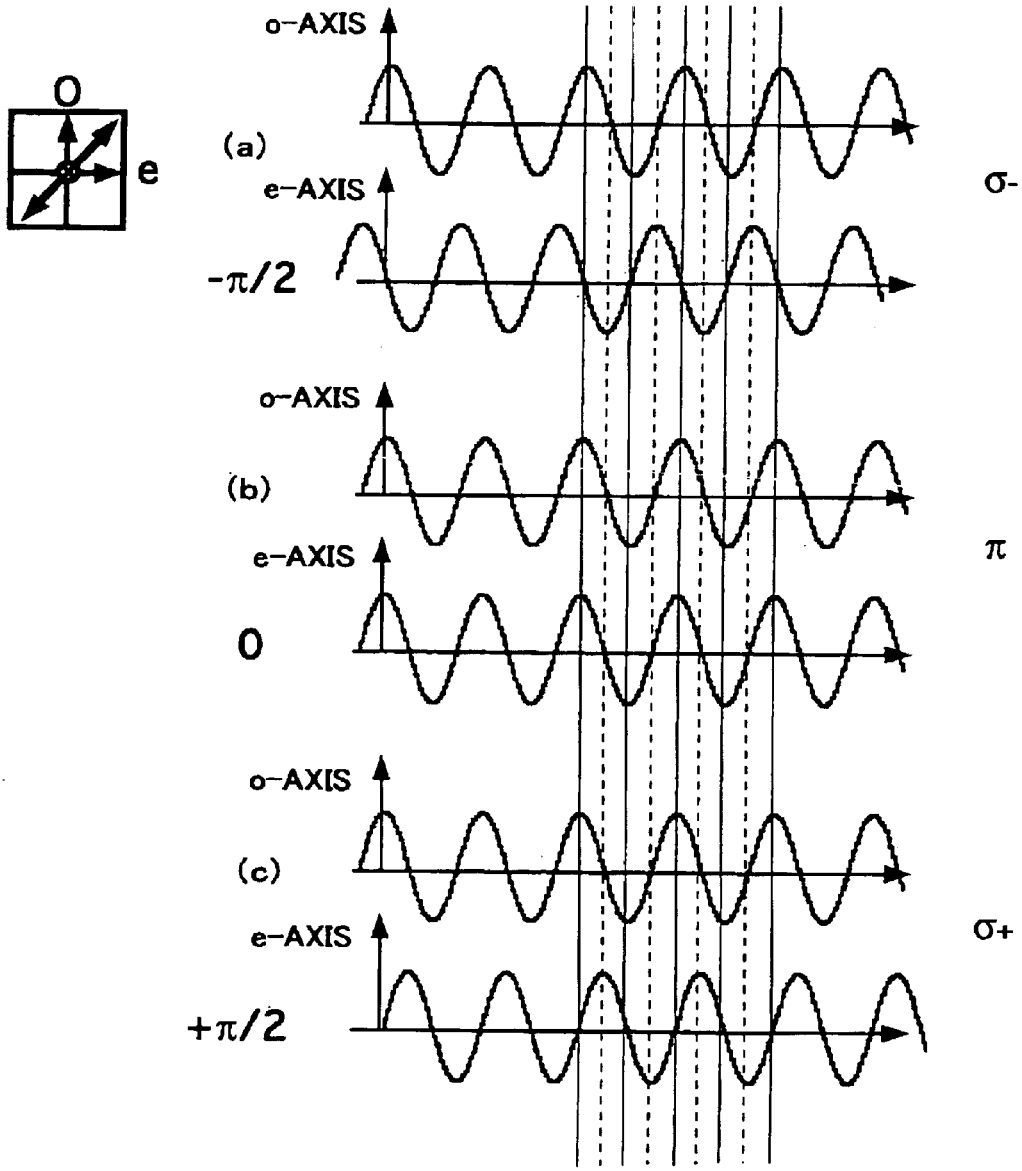
FIGS. 6(*a*), 6(*b*), and 6(*c*) are explanatory diagrams each showing a condition of changes in a phase of laser beams with a birefringent crystal wherein FIG. 6(*a*) shows a condition in which left-handed polarized light ($\sigma-$) appears, when a phase deviates between an o-axis and an e-axis by $-\pi/2$, FIG. 6(*b*) shows a condition in which linearly polarized light appears, when there is no deviation of a phase between the o-axis and the e-axis, and FIG. 6(*c*) shows a condition in which right-handed polarized light ($\sigma+$) appears, when a phase deviates between the o-axis and the e-axis by $\pi/2$.

As described above, an electro-optic device means a material wherein its refractive index is changed by an electric field applied to a birefringent crystal thereby to change a phase of the laser beams passing through there. In FIGS. 6(*a*) through 6(*c*), each situation of changes in phases of laser beams by means of a birefringent crystal is shown. By means of a birefringent crystal, when each phase deviates by $-\pi/2$ between an o-axis and an e-axis as shown in FIG. 6(*a*), left-handed polarized light ($\sigma-$) is realized. Furthermore, as shown in FIG. 6(*b*), there is no deviation between the o- and the e-axes, linearly polarized light ($\pi$) is realized. Moreover, as shown in FIG. 6(*c*), when each phase deviates by $\pi/2$ between the o- and the e-axes, right-handed polarized light ($\sigma+$) is realized.

As shown in FIG. 7, a time required for absorbing and emitting one photon is twice longer than a spontaneous emission lifetime ($\tau$).

When an explanation is specifically made for a silicon atom, its spontaneous emission lifetime is 5.5 ns (nano seconds); a twice-larger value of spontaneous emission lifetime ($\tau$) is 11 ns ($2\tau$=11 ns).

Accordingly, when a photon is hit on a silicon atom in each 11 ns, one photon is efficiently absorbed and emitted, whereby the silicon atom is cooled.

In this case, since a period is "11 ns×4=44 ns", the silicon atom can be efficiently cooled, when a frequency fm is lower than 22.7 MHz in a phase modulator of the polarized light control section 54.

As shown in FIG. 4(*c*), when polarized light of a laser beam emitted to silicon atoms is changed sequentially from right-handed polarized light ($\sigma-$) to left-handed polarized light ($\sigma+$) through linearly polarized light ($\pi$) in each 2.5 ns corresponding to a time interval substantially twice longer than its spontaneous emission lifetime, the silicon atoms can be cooled.

When a light beam in one direction of polarized light is used in case of laser cooling of silicon atoms, cooling cycles, which have been in two dark levels, among three magnetic subsidiary levels of cooling lower levels are not closed. However, when the directions of polarized light are changed, time-varyingly as described above, the cooling cycles can be closed without involving any dark level. Thus, it becomes possible to laser-cool silicon atoms.

The coherent light source section 52 for coherent light may be arranged such that a coherent light source wherein a CW laser (continuous laser) is employed and a coherent light source wherein a picosecond laser is employed are selected properly in response to a case where silicon atoms are to be decelerated by means of a scattering force, or a case where silicon atoms are to be cooled by means of a scattering force.

In FIG. 5, although the embodiment wherein atoms are subjected to laser cooling by the use of the single coherent light source section 52, more specifically one coherent light source device has been described, another embodiment wherein a variety of atoms such as silicon atoms, and germanium atoms are subjected to laser cooling by the use of a plurality of coherent light source sections, more specifically three coherent light source devices will be described by referring to FIGS. 8(*a*) and 8(*b*).

Namely, a laser cooling apparatus 80 according to the present invention includes a first coherent light source device 81 as a first coherent light source section for emitting coherent light of right-handed polarized light ($\sigma+$) (e.g., laser beam), a reflecting mirror 82 for reflecting the coherent light emitted from the first coherent light source device 81, a second coherent light source device 83 as a second coherent light source section for emitting coherent light of linearly polarized light ($\pi$) (e.g., laser beam), a reflecting mirror 84 for reflecting the coherent light emitted from the second coherent light source device 83, a third coherent light source 85 as a third coherent light source section for emitting coherent light of left-handed polarized light ($\sigma-$) (e.g., laser beam), and a reflecting mirror 86 for reflecting the coherent light emitted from the third coherent light source device 85.

Figure 8A:
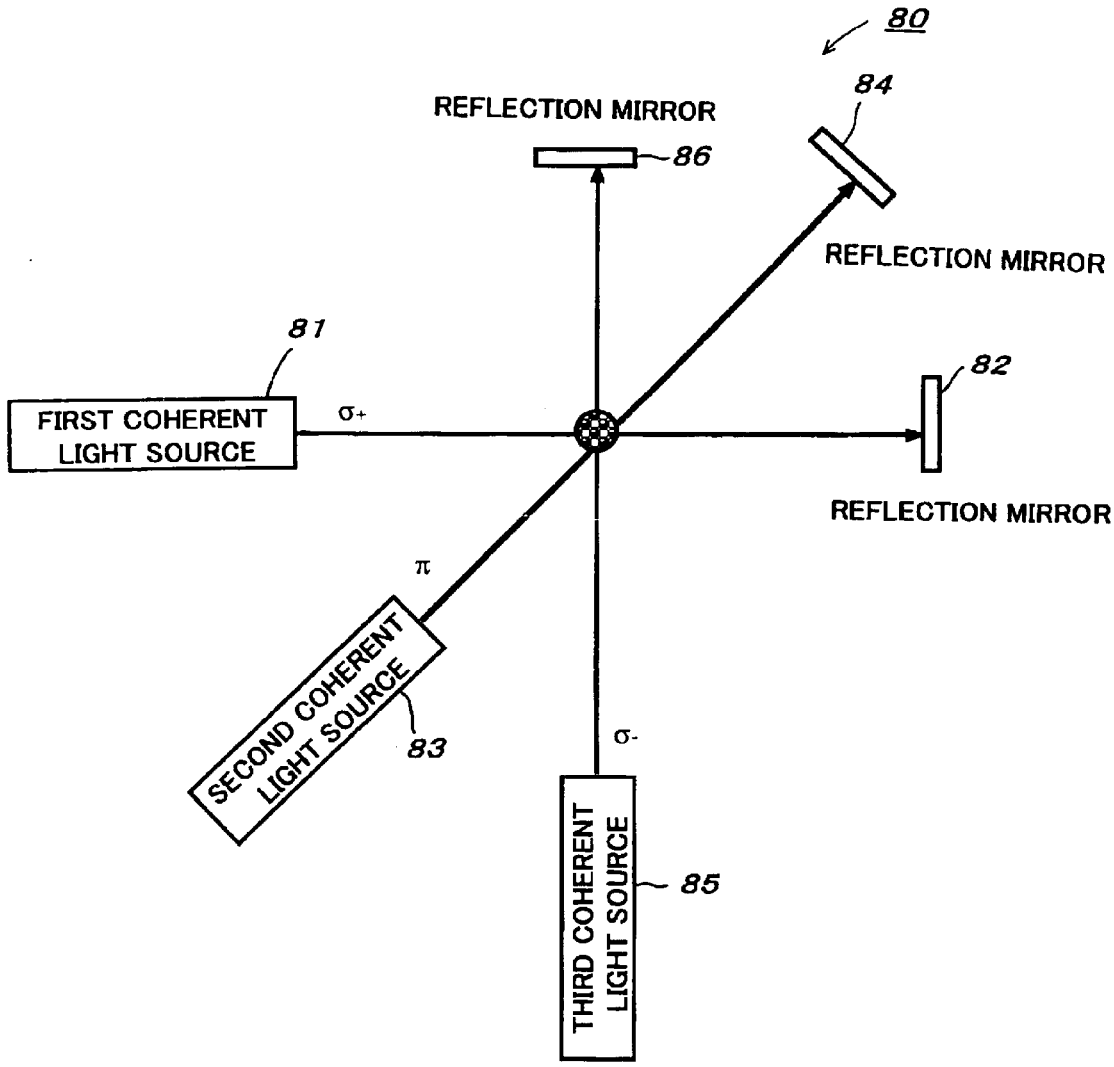
FIGS. 8 (*a*) and 8(*b*) are explanatory views each showing a case of laser-cooling atoms by the use of three coherent light source devices as first through third coherent light sources wherein FIG. 8(*a*) is a conceptual explanatory diagram showing an example of the preferred embodiment of an apparatus for laser cooling of atoms according to the present invention, and FIG. 8(*b*) is a timing chart indicating a timing for emitting each coherent light of three types of polarized light.
Figure 8B:
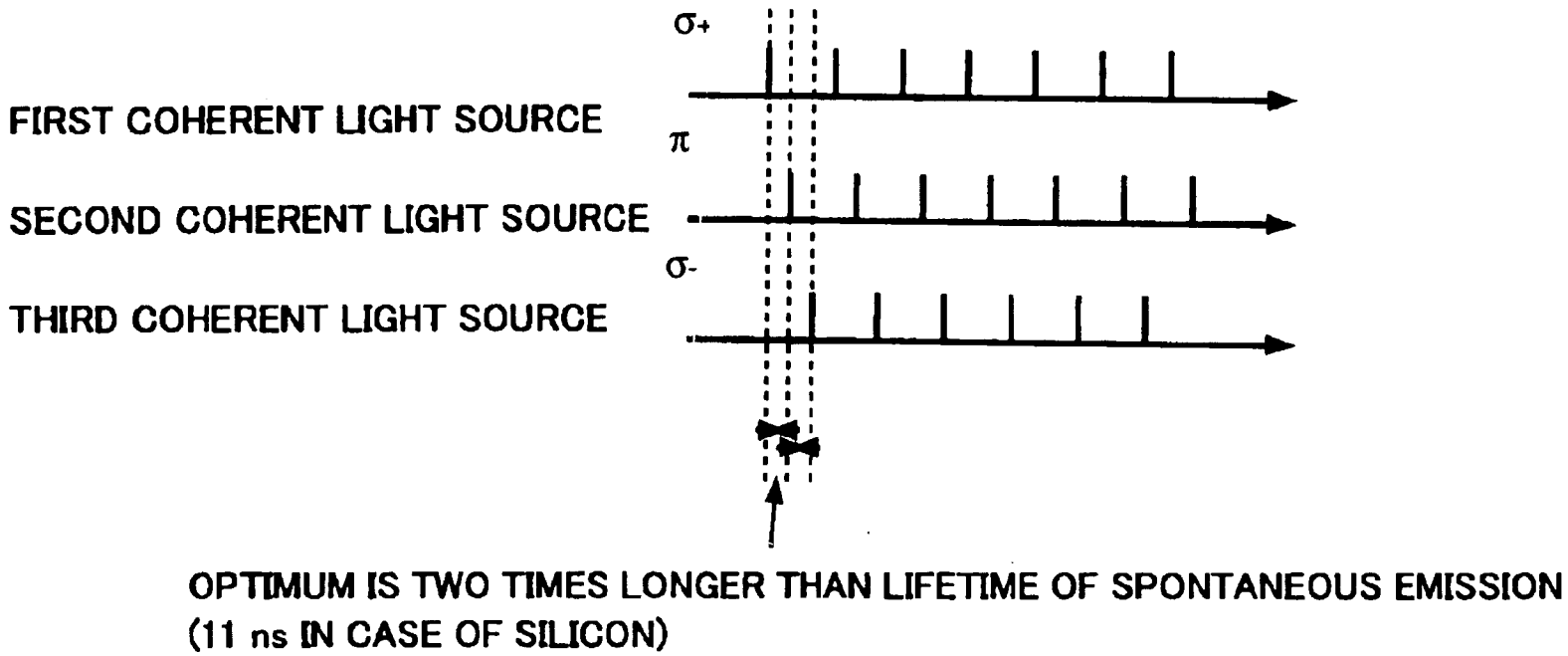

In the laser cooling apparatus 80 according to the present invention shown in FIG. 8(*a*), coherent light may be emitted alternately in order of precedence from the first coherent light source device 81, the second coherent light source device 83, and the third coherent light source device 85 with a time interval corresponding to substantially twice longer than a spontaneous emission lifetime of the atoms.

Next, a further embodiment wherein a variety of atoms such as silicon atoms, and germanium atoms are laser-cooled by the use of a plurality of coherent light source sections, more specifically two coherent light source devices will be described by referring to FIGS. 9(*a*) and 9(*b*).

Figure 9A:
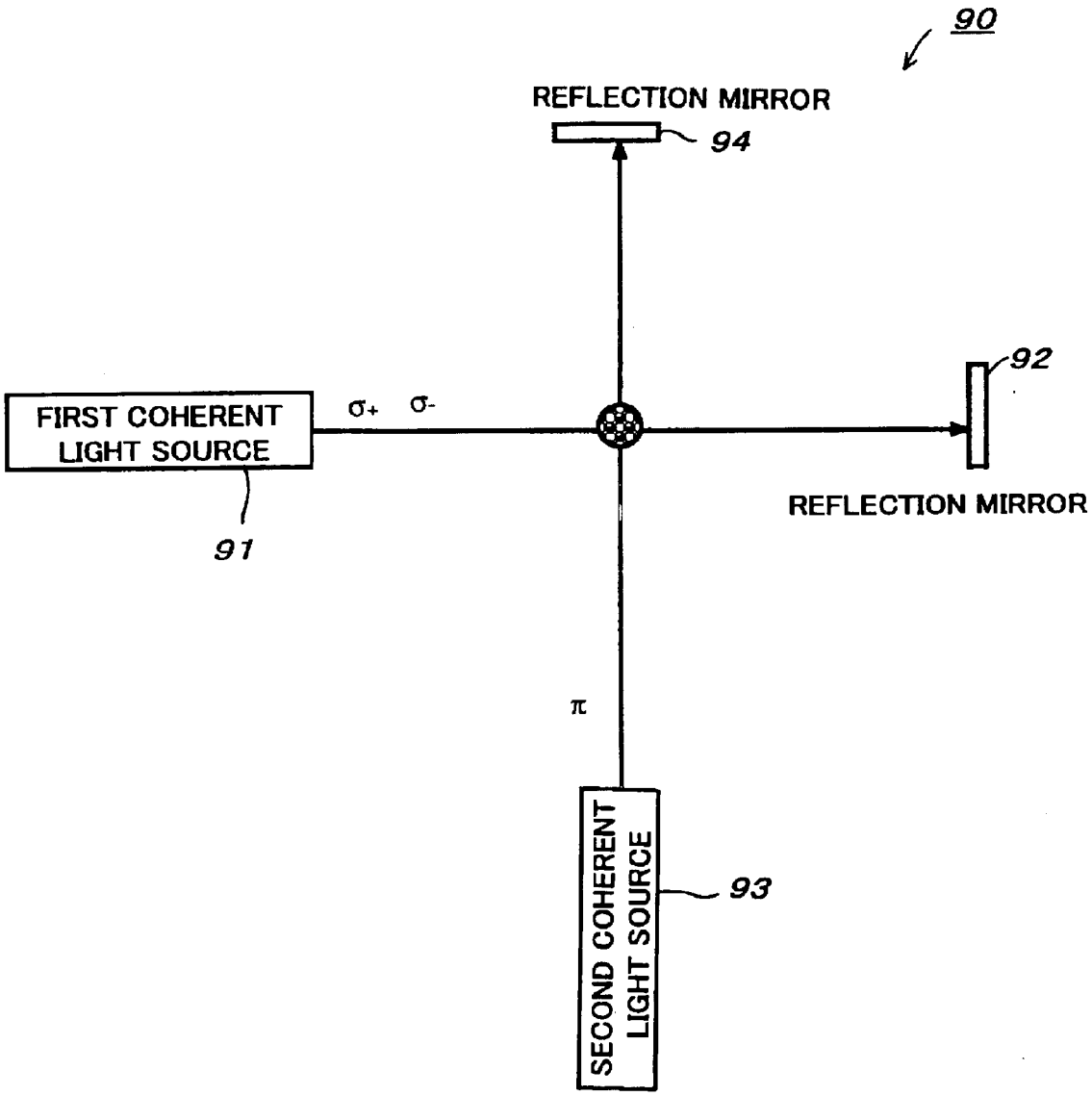
FIGS. 9(*a*) and 9(*b*) are explanatory views each showing a case of laser-cooling atoms by the use of two coherent light, source devices as first and second coherent light sources wherein FIG. 9(*a*) is an explanatory diagram showing an example of the preferred embodiment of an apparatus for laser cooling of atoms according to the present invention, and FIG. 9(*b*) is a timing chart indicating a timing for emitting each coherent light of two types of polarized light.
Figure 9B:
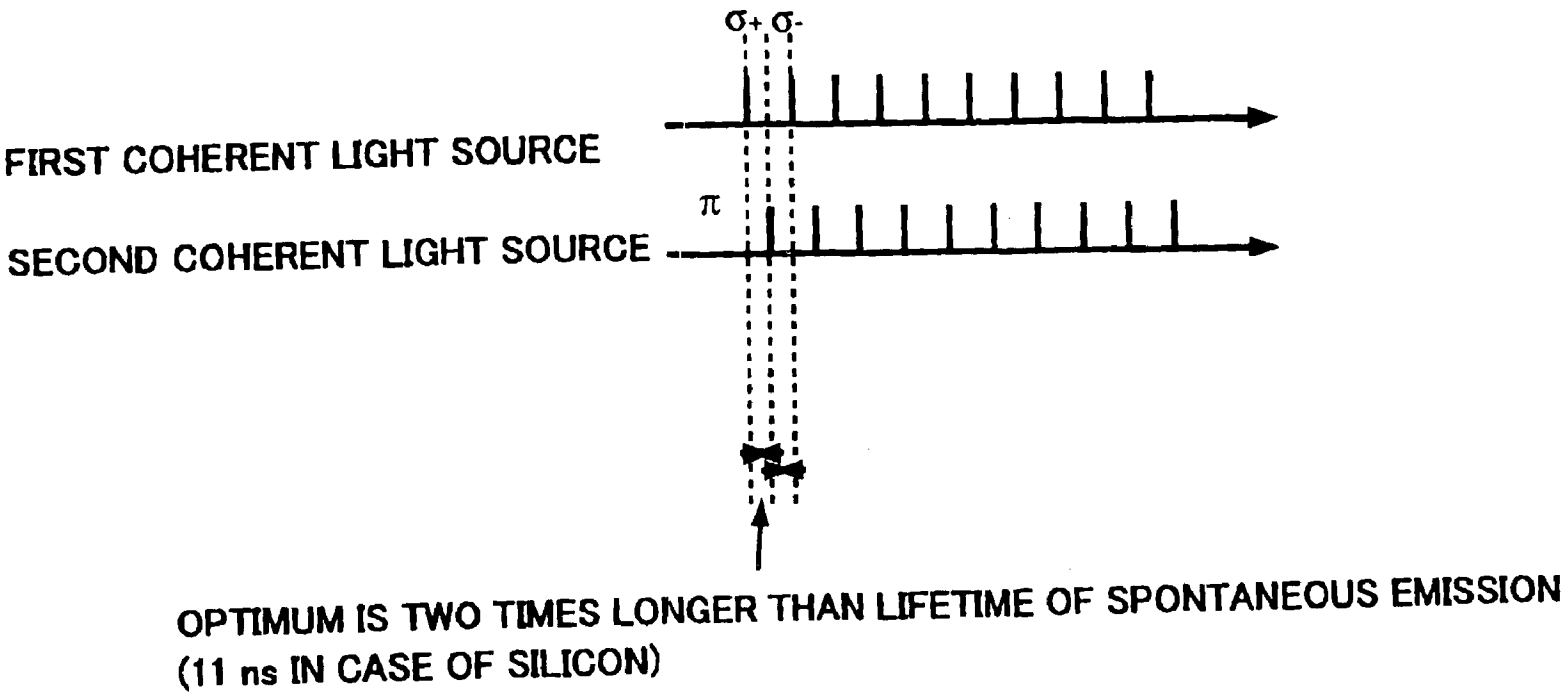

Namely, a laser cooling apparatus 90 according to the present invention shown in FIG. 9(*a*) includes a first coherent light source device 91 for emitting coherent light of polarized light (e.g., laser beam) while switching alternately between right-handed polarized light ($\sigma+$) and left-handed polarized light ($\sigma-$), a reflecting mirror 92 for reflecting the coherent light emitted from the first coherent light source device 91, a second coherent light source device 93 for emitting coherent light of linearly polarized light ($\pi$) (e.g., laser beam), and a reflecting mirror 94 for reflecting the coherent light emitted from the second coherent light source device 93.

In the laser cooling apparatus 90 according to the present invention shown in FIG. 9(*a*), coherent light is emitted with a time interval corresponding to substantially twice longer than a spontaneous emission lifetime of each atom in accordance with the following orders as shown in FIG. 9(*b*):

"Emission of coherent light of right-handed polarized light ($\sigma+$) from the first coherent light source device 91→emission of coherent light of linearly polarized light ($\pi$) from the second coherent light source device 93→emission of coherent light of left-handed polarized light ($\sigma-$) from the first coherent light source device 91→emission of coherent light of linearly polarized light ($\pi$) from the second coherent light source device 93→emission of coherent light of right-handed polarized light ($\sigma+$) from the first coherent light source device 91→emission of coherent light of linearly polarized light ($\pi$) from the second coherent light source device 93→emission of coherent light of left-handed polarized light ($\sigma-$) from the first coherent light source device 91→ . . . "

In the following, an example of a preferred embodiment of a coherent light source used for laser cooling of atoms will be described by referring to FIG. 10.

Figure 10:
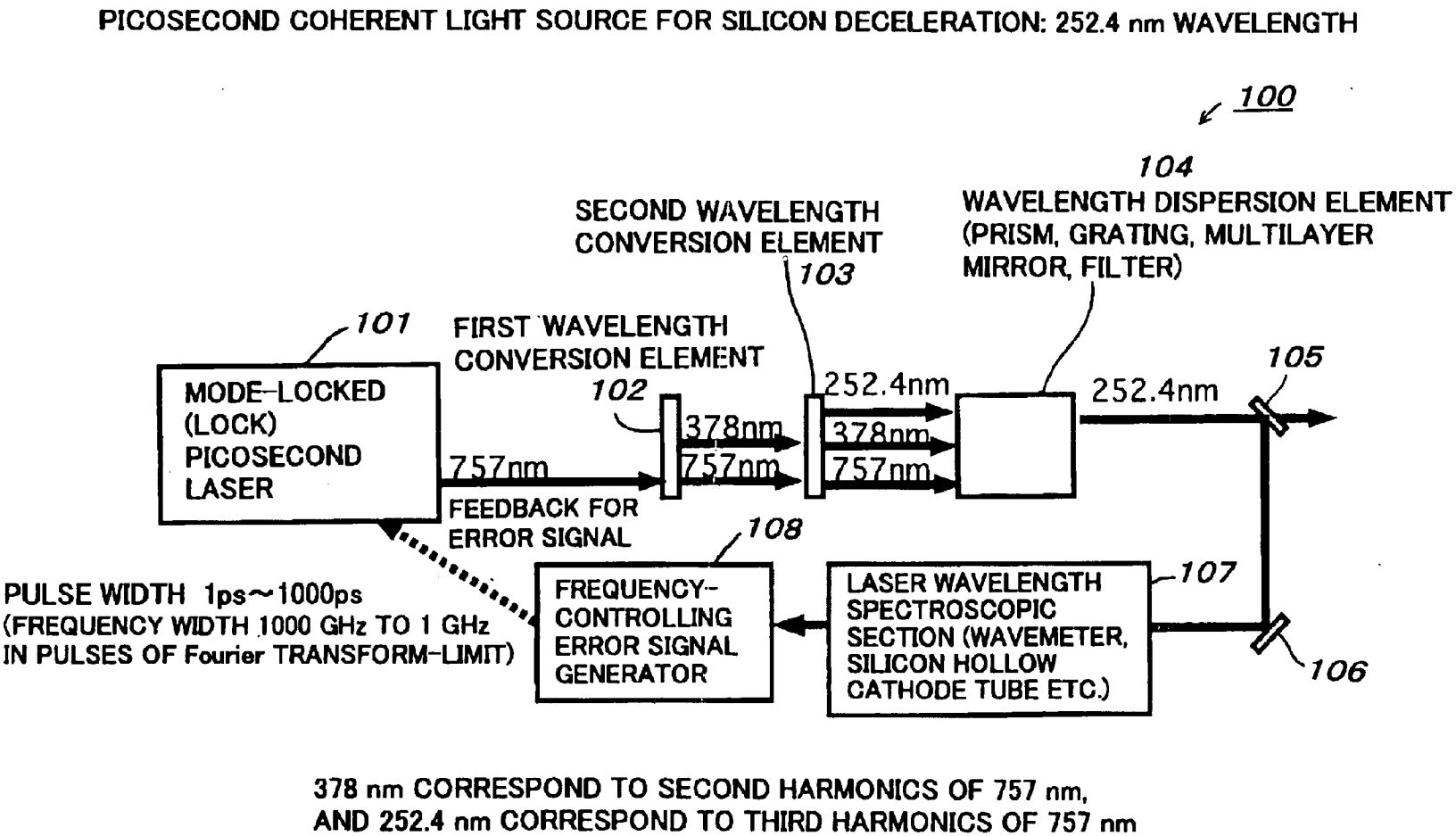
FIG. 10 is an explanatory diagram showing an example of a preferred embodiment of a coherent light source used for laser cooling of atoms, and more particularly an explanatory diagram showing a constitution of a coherent light source used for laser cooling of atoms as a light source for decelerating silicon atoms by means of a scattering force.

An example of the preferred embodiment of a coherent light source used for laser cooling of atoms shown in FIG. 10 is a light source for decelerating silicon atoms by means of a scattering force (hereinafter referred to as "picosecond coherent light source used for silicon deceleration"), and it may be used, for example, as the coherent light source section 52 in the laser cooling apparatus 50 of the present invention shown in FIG. 5; the first coherent light source section, the second coherent light source section, or the third coherent light source section in the laser cooling apparatus 80 according to the invention shown in FIG. 8(*a*); and the first coherent light source section or the second coherent light source section shown in FIG. 9(*a*), as a matter of course. Besides, the above-described light source may be used as a coherent light source in a laser cooling apparatus according to the present invention shown in FIG. 12, which will be described later.

A picosecond coherent light source used for silicon deceleration 100 shown in FIG. 10 is capable of emitting coherent light of 252.4 nm wavelength, which includes a mode-locked (lock) picosecond laser 101, a first wavelength conversion element 102, a second wavelength conversion element 103, a wavelength dispersion element 104, a partial reflection mirror 105, a total reflection mirror 106, a laser wavelength spectroscopic section 107, and a frequency-controlling error signal generator 108. Further, a feedback circuit for inputting an error signal to the mode-locked (lock) picosecond laser 101 as a feedback signal is composed of the partial reflection mirror 105, the total reflection mirror 106, the laser wavelength spectroscopic section 107, and the frequency-controlling error signal generator 108.

In this case, the mode-locked (lock) picosecond laser 101 outputs coherent light having a pulse width of from 1 ps to 1000 ps at 757 nm wavelength (a frequency zone of from 1000 GHz to 1 GHz in Fourier transform-limited pulse).

First, coherent light of 757 nm wavelength output from the mode-locked (lock) picosecond laser 101 is input to the first wavelength conversion element 102, so that coherent light of 757 nm wavelength and coherent light at its second harmonic of 378 nm wavelength are obtained by means of the first wavelength conversion element 102.

Then, coherent light of 757 nm wavelength and coherent light of 378 nm wavelength output from the first wavelength conversion element 102 are input to the second wavelength conversion element 103, so that coherent light of 757 nm wavelength, coherent light being its second harmonic of 378 nm wavelength, and coherent light being its third harmonic of 252.4 nm wavelength are obtained by means of the second wavelength conversion element 103.

Moreover, when coherent light of 757 nm wavelength, coherent light of 378 nm wavelength, and coherent light of 252.4 nm wavelength, output from the second wavelength conversion element 103, are input to the wavelength dispersion element 104, only coherent light of 252.4 nm wavelength is output from the wavelength dispersion element 104 to transmit the partial reflection mirror 105, and the resulting light is used for deceleration of silicon atoms by means of a scattering force. In this case, the wavelength dispersion element 104 is prepared from, for example, a prism, a grating, a multilayer mirror, a filter or the like.

On one hand, coherent light having 252.4 nm wavelength reflected by the partial reflection mirror 105 is reflected by the total reflection mirror 106 to be input to the laser wavelength spectroscopic section 107 composed of a wavemeter, a silicon hollow cathode tube or the like.

A wavelength of the coherent light thus input is measured by the laser wavelength spectroscopic section 107, and the measured result is input to the frequency-controlling error signal generator 108.

The frequency-controlling error signal generator 108 feedbacks an error signal on the basis of the measured result input such that the mode-locked (lock) picosecond laser 101 always produces coherent light having 757 nm wavelength.

As a result of such feedback control, it becomes possible to always emit coherent light of 252.4 nm wavelength to the silicon atoms.

Figure 11:
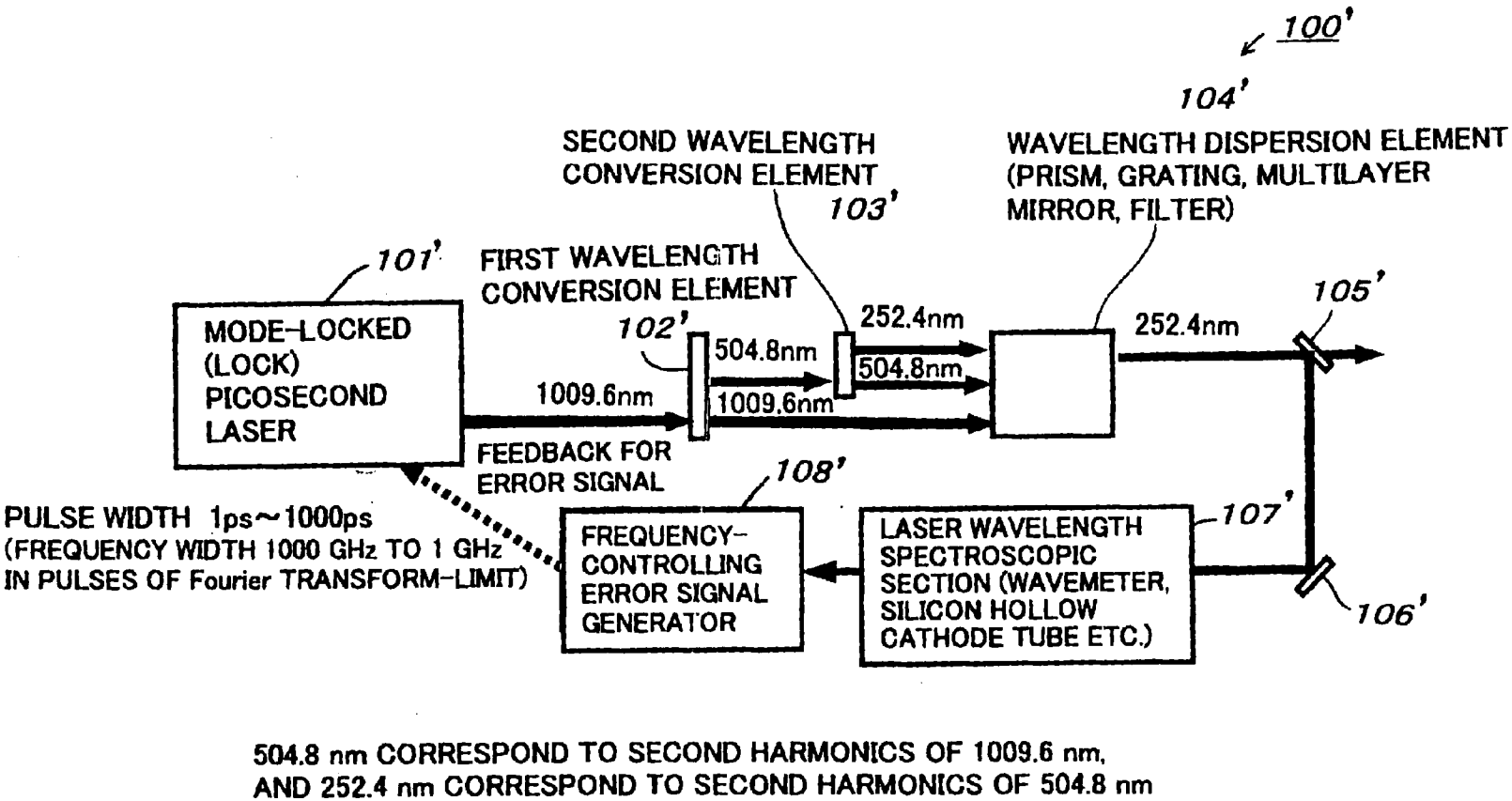
FIG. 11 is an explanatory diagram showing an example of another preferred embodiment of a coherent light source used for laser cooling of atoms, and more particularly an explanatory diagram showing a constitution of a coherent light source used for laser cooling of atoms as a light source for decelerating silicon atoms by means of the scattering force.

FIG. 11 shows an example of another preferred embodiment of the picosecond coherent light source used for silicon deceleration 100 shown in FIG. 10 wherein the same or equivalent components of FIG. 10 are designated by the same reference numerals with a prime sign "'" and the detailed description thereof will be omitted.

A picosecond coherent light source used for silicon deceleration 100' shown in FIG. 11 is capable of emitting coherent light having 252.4 nm, which includes a mode-locked (lock) picosecond laser 101', a first wavelength conversion element 102', a second wavelength conversion element 103', a wavelength dispersion element 104', a partial reflection mirror 105', a total reflection mirror 106', a laser wavelength spectroscopic section 107', and a frequency-controlling error signal generator 108'. Further, a feedback circuit for inputting an error signal to the mode-locked (lock) picosecond laser 101' as a feedback signal is composed of the partial reflection mirror 105', the total reflection mirror 106', the laser wavelength spectroscopic section 107', and the frequency-controlling error signal generator 108'.

In this case, the mode-locked (lock) picosecond laser 101' outputs coherent light having a pulse width of from 1 ps to 1000 ps at 1009.6 nm wavelength (a frequency zone from 1000 GHz to 1 GHz in Fourier transform-limited pulse).

First, coherent light of 1009.6 nm wavelength output from the mode-locked (lock) picosecond laser 101' is input to the first wavelength conversion element 102', so that coherent light of 1009.6 nm wavelength and coherent light being its second harmonics of 504.8 nm wavelength are obtained by means of the first wavelength conversion element 102'.

Then, coherent light of 504.8 nm wavelength output from the first wavelength conversion element 102' is input to the second wavelength conversion element 103', so that coherent light of 504.8 nm wavelength, and coherent light being its second harmonics of 252.4 nm wavelength are obtained by means of the second wavelength conversion element 103' (252.4 nm wavelength corresponds to fourth harmonics of 1009.6 nm wavelength).

Moreover, when coherent light of 504.8 nm wavelength and coherent light of 252.4 nm wavelength output from the second wavelength conversion element 103' as well as coherent light of 1009.6 nm wavelength output from the first wavelength conversion element 102' are input to the wavelength dispersion element 104', only coherent light of 252.4 nm wavelength is output from the wavelength dispersion element 104' to transmit to the partial reflection mirror 105', and the resulting light is used for deceleration of silicon atoms by means of a scattering force. In this case, the wavelength dispersion element 104' is prepared from, for example, a prism, a grating, a multilayer mirror, a filter or the like.

On one hand, coherent light having 252.4 nm wavelength reflected by the partial reflection mirror 105' is reflected by the total reflection mirror 106' to be input to the laser wavelength spectroscopic section 107' composed of a wavemeter, a silicon hollow cathode tube or the like.

A wavelength of the coherent light thus input is measured by the laser wavelength spectroscopic section 107', and the measured result is input to the frequency-controlling error signal generator 108'.

The frequency-controlling error signal generator 108' feedbacks an error signal on the basis of the measured result input such that the mode-locked (lock) picosecond laser 101' always produces coherent light having 1009.6 nm wavelength.

As a result of such feedback control, it becomes possible to always emit coherent light of 252.4 nm wavelength to the silicon atoms.

Figure 12:
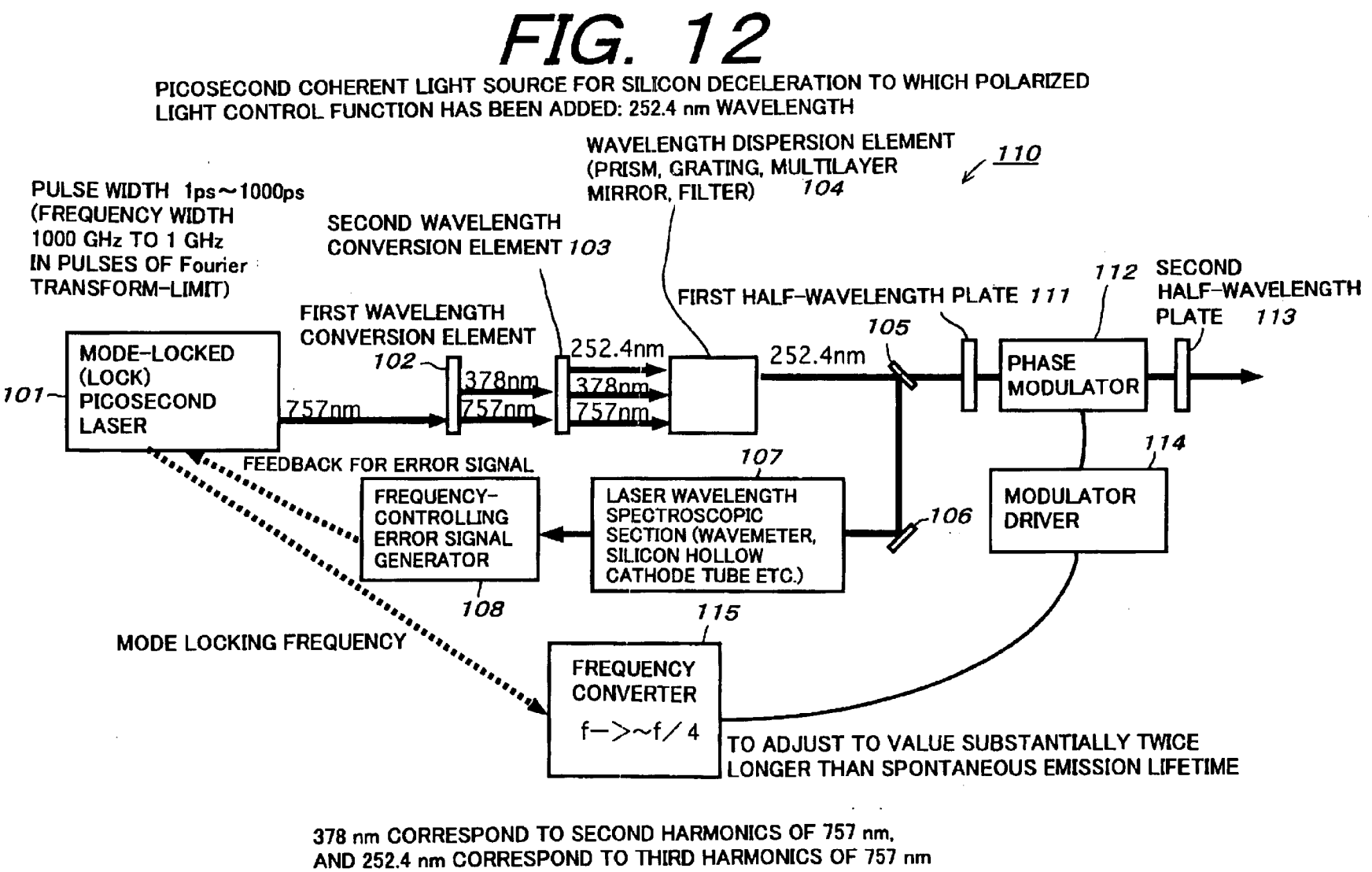
FIG. 12 is an explanatory diagram showing an example of a preferred embodiment of a laser cooling apparatus according to the present invention wherein one of the picosecond coherent light sources each used for deceleration of silicon shown in FIG. 10 (a picosecond coherent light source used for deceleration of silicon to which a function for controlling polarized light has been added) is used as a coherent light source for laser cooling of atoms.

In the following, an example of a preferred embodiment of a laser cooling apparatus according to the present invention wherein one picosecond coherent light source used for silicon deceleration 100 shown in FIG. 10 is used as a coherent light source used for laser cooling of atoms (a picosecond coherent light source used for silicon deceleration to which polarized light control function has been added) will be described by referring to FIG. 12 wherein the same or equivalent components as those of FIG. 10 are designated by the same reference numerals used in FIG. 10, and the detailed description thereof will be omitted.

In a laser cooling apparatus 110 according to the present invention, a first half-wavelength plate 111, a phase modulator 112, a second half-wavelength plate 113, a modulator driver 114, and a frequency converter 115 are mounted as a polarized light control section.

The frequency converter 115 outputs a control signal to the modulator driver 114 such that a modulating signal is output to the phase modulator 112 from the modulator driver 114 in a period which is substantially two times as long as a spontaneous emission lifetime of a silicon atom, when a mode locking frequency is input to the frequency converter 115 and the mode locking frequency is subjected to frequency conversion. In other words, polarized light of coherent light output from the phase modulator 112 is switched in a period substantially twice that of spontaneous emission lifetime of the silicon atom.

More specifically, coherent light of 252.4 nm wavelength is controlled by the polarized light control section to switch at a frequency substantially twice that of the spontaneous emission lifetime of the silicon atom.

Figure 13:
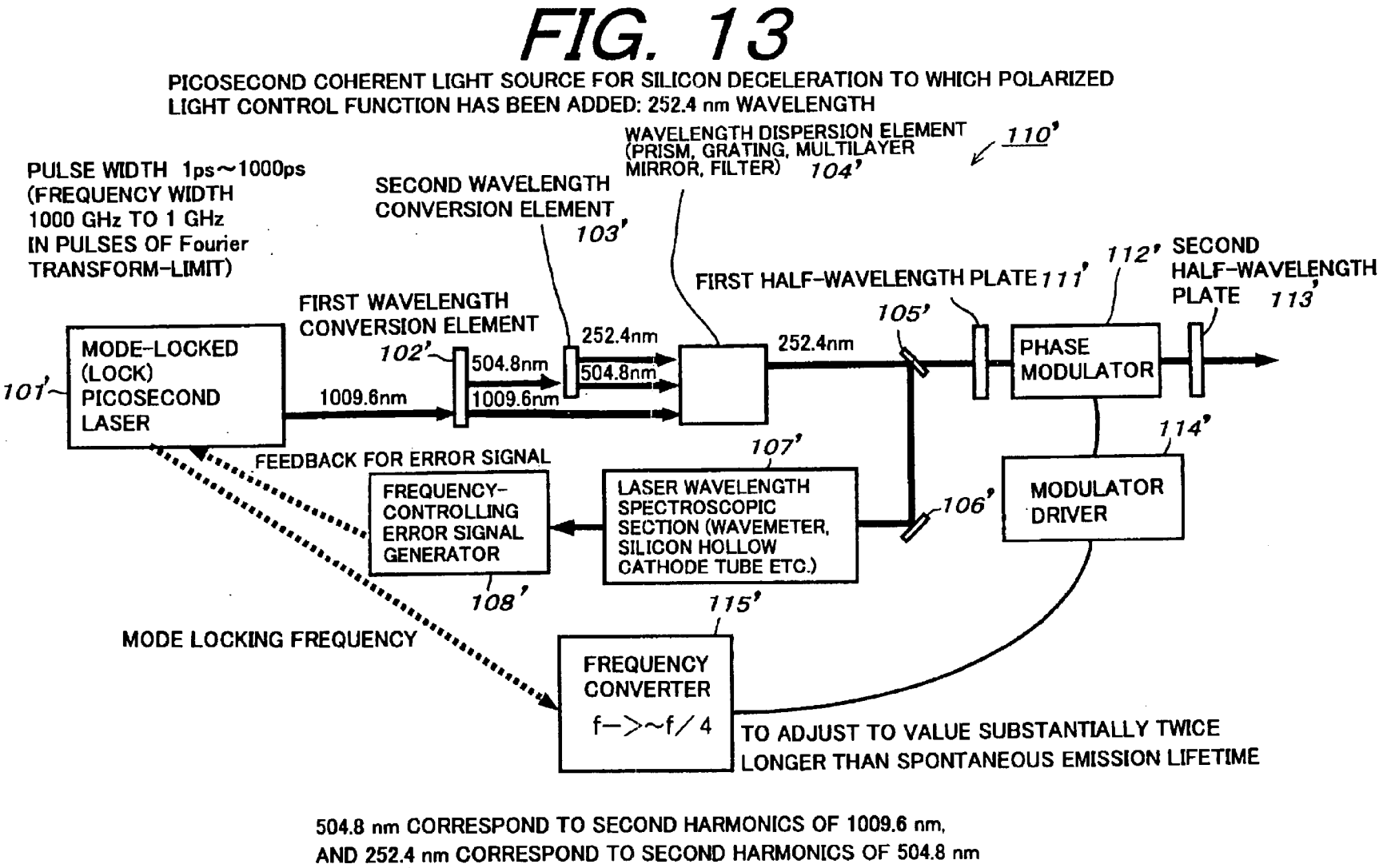
FIG. 13 is an explanatory diagram showing an example of the preferred embodiment of a laser cooling apparatus according to the present invention wherein one of the picosecond coherent light sources used for deceleration of silicon shown in FIG. 11 (a picosecond coherent light source used for deceleration of silicon to which a function for controlling polarized light has been added) is used as a coherent light source for laser cooling of atoms.

In the following, an example of another preferred embodiment of a laser cooling apparatus according to the present invention will be described with reference to FIG. 12. In FIG. 12, one picosecond coherent light source used for silicon deceleration 100', as shown in FIG. 11, is used as a coherent light source for laser cooling atoms. A picosecond coherent light source used for silicon deceleration to which polarized light control function has been added will be described by referring to FIG. 13 wherein the same or equivalent components as illustrated in FIG. 11 are designated by the same reference numerals and the same or equivalent components as illustrated in FIG. 12 are designated by the same numerals with a prime sign "'" and the detailed description for these components will be omitted.

On a laser cooling apparatus 110' according to the present invention, a first half-wavelength plate 111', a phase modulator 112', a second half-wavelength plate 113', a modulator driver 114', and a frequency converter 115' are mounted as a polarized light control section.

The frequency converter 115' outputs a control signal to the modulator driver 114' such that a modulating signal is output to the phase modulator 112' from the modulator driver 114' which is substantially twice longer than a period of a spontaneous emission lifetime of a silicon atom, when a mode locking frequency is input to the frequency converter 115' and the mode locking frequency is subjected to frequency conversion. In other words, polarized light of coherent light output from the phase modulator 112' is switched in a period substantially twice longer than the spontaneous emission lifetime of the silicon atom.

More specifically, coherent light of 252.4 nm wavelength is controlled by the polarized light control section so as to be switched at a frequency substantially twice longer than the spontaneous emission lifetime of the silicon atom.

Next, an example of a preferred embodiment of a laser cooling apparatus wherein a CW laser is used as a coherent light source utilized for laser cooling of atoms producing coherent light having a predetermined wavelength (a CW coherent light source used for silicon deceleration/cooling to which polarized light control function has been added) will be described by referring to FIG. 14.

In a laser cooling apparatus 120 according to the present invention shown in FIG. 14, one CW laser of 252.4 nm wavelength is specifically employed as the above-described CW laser.

The laser cooling apparatus 120 of the present invention can function to effect both deceleration by means of a scattering force and cooling by means of a scattering force with respect to silicon atoms.

Namely, the laser cooling apparatus 120 of the invention is provided with a CW laser 121 of 252.4 nm wavelength for silicon use as a coherent light source used for laser cooling of atoms, and a polarized light control section including a first half-wavelength plate 122, a phase modulator 123, a second half-wavelength plate 124, a modulator driver 125, an oscillator 126, a first lens 127*a*, an acousto-optic device 128, a second lens 127*b*, and an acousto-optic device driver 129.

In the case where silicon atoms are decelerated by a scattering force, a frequency is changed time-varyingly by the use of the acousto-optic device 128 to implement chirped cooling.

On one hand, in the case where silicon atoms are cooled by a scattering force, the acousto-optic device 128 has the effect of separating time-varyingly polarized light and is convenient for optimizing a frequency.

It is effective for chirped cooling to additionally install an electro-optic shifter (EO shifter) between the CW laser 121 for silicon use and the first half-wavelength plate 122 to increase a frequency shift amount. Accordingly, such an electro-optic shifter may optionally be disposed in the above-described position.

The CW laser 121 for silicon use of 252.4 nm wavelength can be, for example, a fiber laser or fourth harmonics of a semiconductor laser of 1009.6 nm, or a second harmonics of a semiconductor laser of 504.8 nm wavelength or a semiconductor laser of 252.4 nm wavelength.

A construction of a coherent light source that can be used as the above-described CW laser 121 for silicon use, i.e., a coherent light source producing CW laser beam having wavelengths in a deep ultraviolet region that is applicable for a coherent light source used for laser cooling of atoms, will be described herein by referring to FIGS. 15 through 17.

Figure 15:
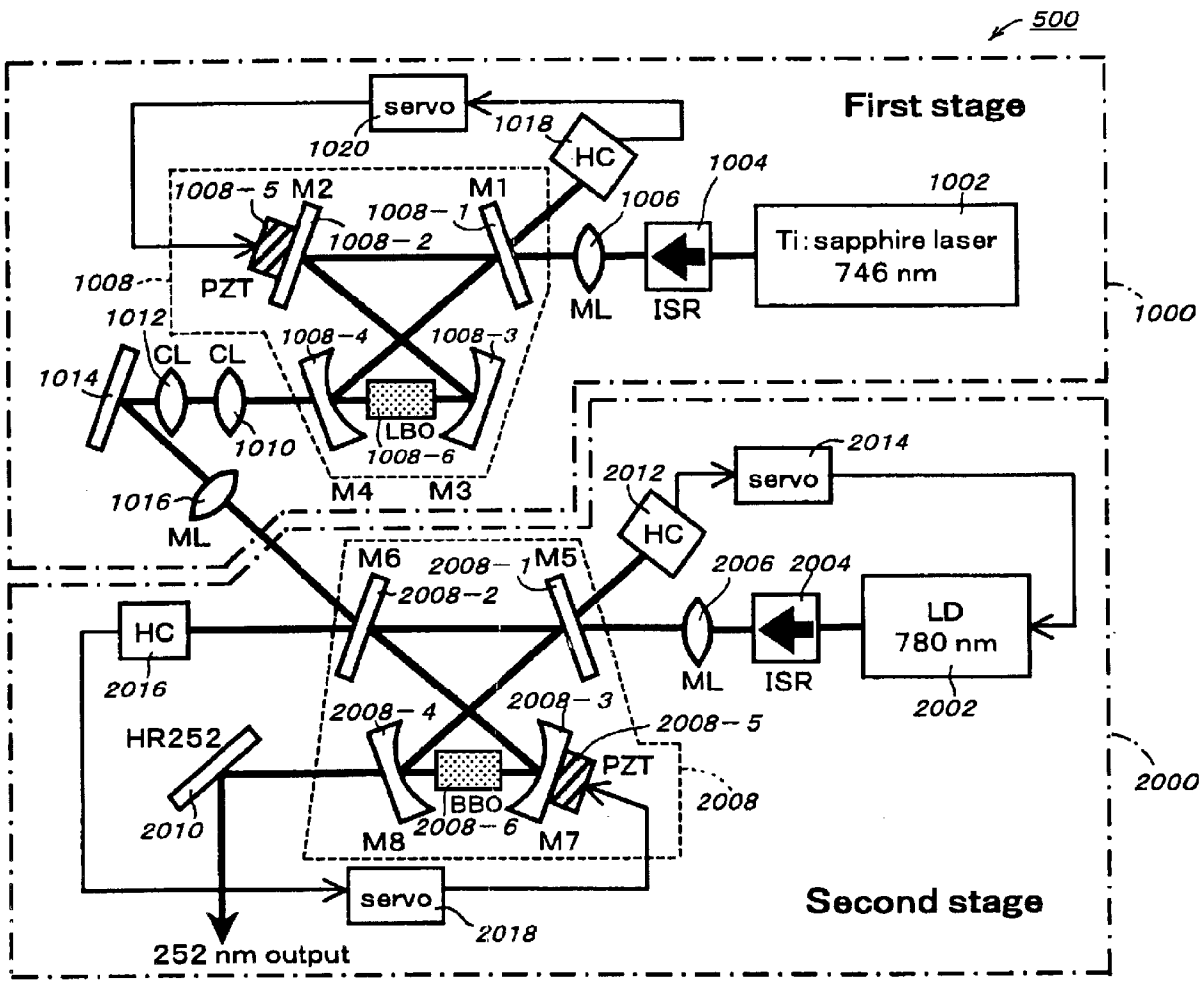
FIG. 15 is a schematic explanatory diagram showing a constitution of a coherent light source, which can be used as the CW laser for silicon of 252.4 nm wavelength designated by reference numeral 121 in FIG. 14.

FIG. 15 shows a schematic illustration of a coherent light source 500 that is applicable for the CW laser 121 for silicon use. The coherent light source 500 is constituted from a two-stage external resonator type wavelength conversion system, which is composed of a first stage external resonator type wavelength conversion system 1000 functioning as a first laser beam producing system for producing a laser beam having a first wavelength, and a second stage external resonator type wavelength conversion system 2000 functioning as a second laser beam producing system, which produces a laser beam having a second wavelength, and in addition, introduces the laser beam having the first wavelength produced in the first stage external resonator type wavelength conversion system 1000 thereinto to generate laser beam having a third wavelength by means of sum frequency mixing of the laser beam of the first wavelength and the laser beam of the second wavelength at high efficiency.

The first stage external resonator type wavelength conversion system 1000 of the coherent light source 500 includes a ring type single mode titanium sapphire laser (Ti:sapphire laser 746 nm) 1002 excited by second harmonics of Nd:$YVO_4$ laser to output laser beam of 746 nm wavelength; an isolator (IRS) 1004 for adjusting the laser beam output from the ring type single mode titanium sapphire laser 1002; a mode matching lens (ML) 1006 for effecting mode matching of the laser beam output from the isolator 1004; a resonator main body 1008 for inputting the laser beam output from the mode matching lens 1006; a first condensing lens 1010 for condensing the laser beam output from the resonator main body; a second condensing lens 1012 for further condensing the laser beam output from the first condensing lens 1010; a total reflection mirror 1014 for changing an optical path of the laser beam output from the second condensing lens 1012; a mode matching lens (ML) for mode-matching the laser beam output from the total reflection mirror 1014; an error signal generator (HC) 1018 for utilizing polarized light of the laser beam that is transmitted through an input coupling mirror (M1) 1008-1 (which will be described later) constituting the resonator main body 1008; and a servo mechanism for driving a piezo element (PZT) 1008-5 (which will be described later) that minutely moves a disposed position of a total reflection mirror (M2) 1008-2 (which will be described later) constituting the resonator main body 1008 based on an error signal output from the error signal generator 1018.

In this case, the resonator main body 1008 involves the input coupling mirror 1008-1 for introducing the laser beam of 746 nm laser beam output from the mode matching lens 1006 into the resonator main body 1008, the total reflection mirror 1008-2 a disposed position of which is moved minutely by driving the piezo element 1008-5, a total reflection mirror (M3) 1008-3, an output mirror 1008-4 for outputting laser beam outside the resonator main body 1008, the piezo element 1008-5 for minutely moving a disposed position of the total reflection mirror 1008-2, and a $LiB_3O_5$ crystal (LBO) 1008-6 disposed on an optical path extending from the total reflection mirror 1008-3 and the output mirror 1008-4.

The $LiB_3O_5$ crystal 1008-6 produces second harmonics (373 nm wavelength) of the laser beam of 746 nm wavelength. Furthermore, the $LiB_3O_5$ crystal 1008-6 has an excision angle of "$\theta$=90°" and "$\phi$=37.5°", a crystal length of 15 mm, and on an input side (a side of the total reflection mirror 1008-3) of which antireflection coating of 746 nm wavelength has been applied, while on an output side (a side of the output mirror 1008-4) of which antireflection coating of 746 nm wavelength as well as antireflection coating of 373 nm wavelength have been applied.

The input coupling mirror 1008-1 is arranged such that 2% of the laser beam of 746 nm wavelength is transmitted, the laser beam of 373 nm wavelength is not transmitted, 98% of the laser beam of 746 nm wavelength is reflected, and 99.9% or more of the laser beam of 373 nm wavelength is reflected. The total reflection mirror 1008-2 is arranged such that the laser beam of 746 nm wavelength is not transmitted, the laser beam of 373 nm wavelength is not transmitted, 99.9% or more of the laser beam of 746 nm wavelength is reflected, and 99.9% or more of the laser beam of 373 nm wavelength is reflected. Moreover, the total reflection mirror 1008-3 is arranged such that the laser beam of 746 nm wavelength is not transmitted, the laser beam of 373 nm wavelength is not transmitted, 99.9% or more of the laser beam of 746 nm wavelength is reflected, and 99.9% or more of the laser beam of 373 nm wavelength is reflected. Furthermore, the output mirror 1008-4 on which multilayer coating has been doubly applied is arranged such that 95% of the laser beam of 373 nm wavelength is transmitted, and 99.9% or more of the laser beam of 746 nm wavelength is reflected.

The above-described four mirrors (the input coupling mirror 1008-1, the total reflection mirror 1008-2, the total reflection mirror 1008-3, and the output mirror 1008-4) are disposed so as to make such an optical path wherein the laser beam of 746 nm wavelength that was output from the mode matching lens 1006 transmits to the input coupling mirror 1008-1 to which the laser beam was input, proceeds to the reflection mirror 1008-2, from which it proceeds to the total reflection mirror 1008-3, from which it proceeds to the $LiB_3O_5$ crystal 1008-6, proceeds to the output mirror 1008-4, and from which it proceeds to the input coupling mirror 1008-1. Accordingly, an optical path of the laser beam in a region surrounded by the input coupling mirror 1008-1, the total reflection mirror 1008-2, the total reflection mirror 1008-3, and the output mirror 1008-4 exhibits a bow-tie shape.

Ninety-five (95)% of the transmitted laser beam of 373 nm wavelength among the laser beams, which passed through the $LiB_3O_5$ crystal 1008-6 from the total reflection mirror and proceeded to the output mirror 1008-4, proceeds to the first condensing lens 1010. Further, two (2)% of the transmitted laser beam of 746 nm wavelength among the laser beams, which proceeded to the input coupling mirror 1008-2 from the output mirror 1008-4, proceeds to the error signal generator 1018.

The second stage external resonator type wavelength conversion system 2000 of the coherent light source 500 includes a single mode semiconductor laser outputting a laser beam of 780 nm wavelength (LD 780 nm) 2002; an isolator (IRS) 2004 for adjusting the laser beam output from the single mode semiconductor laser 2002; a mode matching lens (ML) 2006 for effecting mode matching the laser beam output from the isolator 2004; a resonator main body 2008 for inputting the laser beam output from the mode matching lens 2006; a high reflection mirror (HR 252) 2010 for reflecting the laser beam of 252 nm output from the resonator main body 2008 to introduce the reflected laser beam outside the coherent light source 500; an error signal generator (HC) 2012 for utilizing polarized light of the laser beam that is transmitted through an input coupling mirror (M5) 2008-1 (which will be described later) constituting the resonator main body 2008; a servo mechanism 2014 for driving the single mode semiconductor laser 2002 based on an error signal output from the error signal generator 2012; an error signal generator (HC) 2016 for utilizing polarized light of the laser beam that transmitted through an input coupling mirror (M5) 2008-2 (which will be described later) constituting the resonator main body 2008; and a servo mechanism 2018 for driving a piezo element (PZT) 2008-5 that minutely moves a disposed position of a total reflection mirror (M7) 2008-3 (which will be described later) constituting the resonator main body 2008 based on an error signal output from the error signal generator 2016.

In this case, the resonator main body 2008 involves the input coupling mirror 2008-1 for introducing the laser beam of 780 nm laser beam output from the mode matching lens 2006 into the resonator main body 2008, the input coupling mirror 2008-2 for introducing the laser beam of 373 nm wavelength output from the first stage external resonator type wavelength conversion system 1000 into the resonator main body 2008, the total reflection mirror (M7) 2008-3, a disposed position of which is minutely moved by driving the piezo element 2008-5, an output mirror (M8) 2008-4 for outputting the laser beam outside the resonator main body 2008, the piezo element 2008-5 for minutely moving a disposed position of the total reflection mirror 2008-3, and a $\beta$-$BaB_2O_4$ crystal (BBO) 2008-6 disposed on an optical path extending from the total reflection mirror 2008-3 to the output mirror 2008-4. The $\beta$-$BaB_2O_4$ crystal 2008-6 produces a laser beam of 252 nm wavelength as a result of the sum frequency mixing, as mentioned hereinafter.

The input coupling mirror 2008-1, to which a multilayer coating has been doubly applied, is arranged such that 2% of the laser beam of 780 nm wavelength is transmitted, 0.02% of the laser beam of 373 nm wavelength is transmitted, 98% of the laser beam of 780 nm wavelength is reflected, and 99.8% of the laser beam of 373 nm wavelength is reflected. Moreover, the input coupling mirror 2008-2 to which multilayer coating has been doubly applied is arranged such that 2% of the laser beam of 373 nm wavelength is transmitted, 0.02% of the laser beam of 780 nm wavelength is transmitted, 98% of the laser beam of 373 nm wavelength is reflected, and 99.8% of the laser beam of 780 nm wavelength is reflected. Further, the total reflection mirror 2008-3 is arranged such that the laser beam of 746 nm wavelength is not transmitted, the laser beam of 373 nm is not transmitted, 99.9% or more of the laser beam of 746 nm is reflected, and 99.9% of the laser beam of 373 nm wavelength is reflected. The output mirror 2008-4, to which a multilayer coating has been triply applied, is arranged such that 84% of the laser beam of 252 nm wavelength is transmitted, while it exhibits 99.98% or more of reflectivity with respect to the laser beam of 373 nm wavelength and the laser beam of 780 nm wavelength.

The above-described four mirrors (the input coupling mirror 2008-1, the input coupling mirror 2008-2, the total reflection mirror 2008-3, and the output mirror 2008-4) are disposed so as to make such an optical path that the laser beam of 746 nm wavelength, that was output from the mode matching lens 2006, transmits to the input coupling mirror 2008-1 to which the laser beam was input, proceeds to the input coupling mirror 2008-2, from which it proceeds to the total reflection mirror 2008-3, from which it passes through the $\beta$-$BaB_2O_4$ crystal 2008-6 to proceed to the output mirror 2008-4, and from which it proceeds to the input coupling mirror 2008-1. These four mirrors are disposed so as to make an optical path wherein the laser beam of 373 nm wavelength outputs from the first stage external resonator type wavelength conversion system 1000 transmits to the input coupling mirror 2008-2 to which the laser beam was input, proceeds to the total reflection mirror 2008-3, from which it passes through the $\beta$-$BaB_2O_4$ crystal 2008-6 to proceed to the output mirror 2008-4, from which it proceeds to the input coupling mirror 1008-1, and from which it proceeds to the input coupling mirror 2008-2.

Accordingly, an optical path of the laser beam in a region surrounded by the input coupling mirror 2008-1, the input coupling mirror 2008-2, the total reflection mirror 2008-3, and the output mirror 2008-4 exhibits a bow-tie shape.

Eighty-four (84)% of the transmitted laser beam of 252 nm wavelength among the laser beams, which proceeded to the total reflection mirror 2008-3, transmits to proceed to the high reflection mirror (HR 252) 2010. Further, two (2)% of the transmitted laser beam of 746 nm wavelength among the laser beams, which proceeded to the input coupling mirror 2008-1 from the output mirror 2008-4, proceeds to the error signal generator 2012, and two (2)% of the transmitted laser beam of 373 nm wavelength among the laser beams, which proceeded to the input coupling mirror 2008-2 from the input coupling mirror 2008-1, proceeds to the error signal generator 2016.

In the following, an outline of operations in the coherent light source 500 will be described. First, in the first stage of the external resonator type wavelength conversion system 1000, the laser beam of 746 nm wavelength outputs from the ring type single mode titanium sapphire laser 1002 and is introduced into the resonator main body 1008. Light intensity thereof is increased in the resonator main body 1008, whereby second harmonics (373 nm wavelength) are generated efficiently by means of the $LiB_3O_5$ crystal 2008-6 in the resonator main body 1008.

Succeedingly, in the second stage external resonator type wavelength conversion system 2000, the laser beam having 373 nm wavelength of the second harmonic obtained by the first stage external resonator type wavelength conversion system 1000 and a laser beam having 780 nm wavelength of the single mode semiconductor laser 2002 are introduced to the resonator main body 200B a resonator length is fixed while maintaining resonance of the laser beam of 373 nm wavelength, and a frequency of the laser beam of 780 nm wavelength is minutely adjusted to stabilize the same, whereby both the wavelengths are doubly resonated. As a result of the simultaneous resonance of two wavelengths, the respective light intensities are increased at the same time, so that a laser beam of 252 nm wavelength is generated at high efficiency as a result of the sum frequency mixing by means of the $\beta$-$BaB_2O_4$ crystal 2008-6 in the resonator main body 2008.

In the following, details of generation of a second harmonics in the first stage external resonator type wavelength conversion system 1000 will be described.

In the first stage external resonator type wavelength conversion system 1000, the laser beam of 746 nm wavelength output from the ring type single mode CW titanium sapphire laser 1002 is introduced to the resonator main body 1008 provided with an bow-tie shaped optical path through the mode matching lens 1006. The resonator main body 1008 utilizes polarized light to increase interior light intensity while feeding back an error signal to the piezo element 1008-5 mounted additionally to the total reflection mirror 1008-2.

As described above, the $LiB_3O_5$ crystal 1008-6, which has been used as a nonlinear optical crystal, has an excision angle of "$\theta$=90°" and "$\phi$=37.5°", a crystal length of 15 mm, and on an input side thereof antireflection coating of 746 nm wavelength has been applied, while on an output side thereof antireflection coating of 746 nm wavelength as well as antireflection coating of 373 nm wavelength have been applied.

Furthermore, since a loss in one round in an optical path of the external resonator main body 1088 may be estimated as 2%, optical impedance matching is intended with 98% reflectivity of the input coupling mirror 1008-1.

The output mirror 1008-4 to which multilayer coating has been doubly applied is arranged in such that, as described above, 95% of the laser beam of 373 nm wavelength is transmitted, and 99.9% of the laser beam of 746 nm wavelength is reflected. Each focal length of the total reflection mirror 1008-3 and the output mirror 1008-4 is 100 mm, and one round length in an optical path of the resonator main body is set to 650 mm.

A layout of four mirrors (the input coupling mirror 1008-1, the total reflection mirror 1008-2, the total reflection mirror 1008-3, and the output mirror 1008-4) and the $LiB_3O_5$ crystal 2008-6 is established so as to coincide a mode of the resonator main body 1008 with a mode of the input beam, and to be the optimum value of 35 $\mu$m that was calculated such that a beam waist size at the central part of the $LiB_3O_5$ crystal 2008-6 became optimum. In the optimum condition, a conversion efficiency of a single optical path becomes "$9.1\times10^{-5}W^{-1}$". The second harmonics output from the external resonator 1008 is paralleled independently in the vertical and horizontal directions thereof by means of two condenser lenses 1010 and 1012 in order to compensate for a divergence angle, different vertically and horizontally, that is produced by a walk off effect in a nonlinear crystal.

Figure 16:
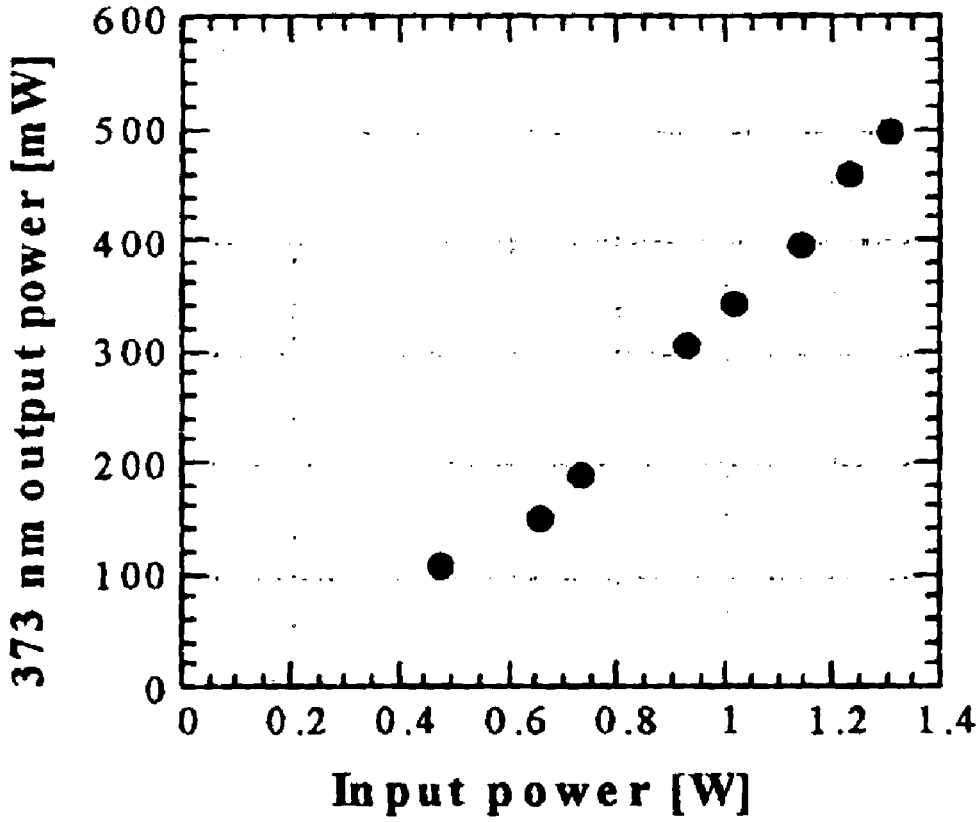
FIG. 16 is a graphical representation indicating input-output characteristics in second harmonic wave generation of the coherent light source shown in FIG. 15 wherein input-output characteristics of output light having 373 nm wavelength with respect to input light having 746 nm wavelength are indicated.

FIG. 16 indicates input fundamental wave dependency of a measured output of second harmonics wherein the maximum output of second harmonics was 500 mW. This result means that there was an output of 520 mW or higher immediately after the $LiB_3O_5$ crystal 2008-6 with taking transmission factors of the $LiB_3O_5$ crystal 2008-6 and the output mirror 1008-4 into consideration. In this case, conversion efficiency from an input fundamental wave to an output of second harmonics is even 40% or more.

An enhancement factor measured was 72 and this result means that a conversion efficiency of a single optical path comes to be "$5.9\times10^{-5}W^{-1}$" being 65% of the optimum value. As a cause for the result, it may be point out that there is a discrepancy of beam waist due to misalignment or the like. A loss for one round, including the one due to incomplete coating, may be estimated to be 1%. When a reflectivity of the input coupling mirror 1008-1 is optimized, elevation of the optical impedance matching will occur.

Next, details of generation of sum frequency in the second stage external resonator type wavelength conversion system 2000 will be described.

The resonator main body 2008 in the second stage external resonator type wavelength conversion system 2000 shown in the lower part of FIG. 15 is provided with a bow-tie shaped optical path as in the resonator main body 1008 in the first stage external resonator type wavelength conversion system 1000, and involves the input coupling mirror 2008-1 for the laser beam of 780 nm wavelength output from the taper type amplifier semiconductor laser 2002, and the input coupling mirror 2008-2 for second harmonics (373 nm wavelength) obtained by the resonator main body 1008 in the first stage external resonator type wavelength conversion system 1000.

As described above, each of these two input coupling mirrors has a reflection coefficient of 98% at their respective wavelengths, while each of them has a reflection coefficient of 99.8% or more at the other respective wavelengths. Moreover, the multilayer coating has been applied triply to the output mirror 2008-4 wherein 84% of light having 252 nm wavelength are transmitted the mirror, but it exhibits 99.8% or higher reflectivity with respect to light having 373 nm wavelength and light of 780 nm wavelength.

A concave mirror having 50 mm curvature is used for each of the total reflection mirror 2008-3 and the output mirror 2008-4, and a resonator length is set to about 300 mm corresponding to about half of that of the resonator main body 1008 in the first stage external resonator type wavelength conversion system 1000.

Moreover, 17.1° cut $\beta$-$BaB_2O_4$ crystal 2008-6 having 10 mm length is used as a nonlinear crystal of the second stage external resonator type wavelength conversion system 2000. Anti-reflection coating has been applied to both end surfaces of the $\beta$-$BaB_2O_4$ crystal 2008-6 with respect to two types of input light (laser beam of 780 nm wavelength and second harmonics (laser beam of 373 nm wavelength)), and particularly, a further coating has been applied to the output side so as to obtain 95% transmission with respect to light having 252 nm wavelength.

In the resonator main body 2008 of the second stage external resonator type wavelength conversion system 2000, a feedback loop for resonating two types of light having a different frequency is formed.

Namely, a resonator length is controlled so as to resonate light having 373 nm wavelength by the use of the piezo element mounted on the total reflection mirror 2008-3 in accordance with the first feedback loop. More specifically, a feedback is applied after the resonator length was fixed in such that an oscillation frequency of the single mode semiconductor laser 2002 coincides with a resonator frequency that has been just stabilized, whereby simultaneous resonance of the laser beam of 373 nm wavelength and the laser beam of 780 nm wavelength was realized in the same resonator.

Figure 17:
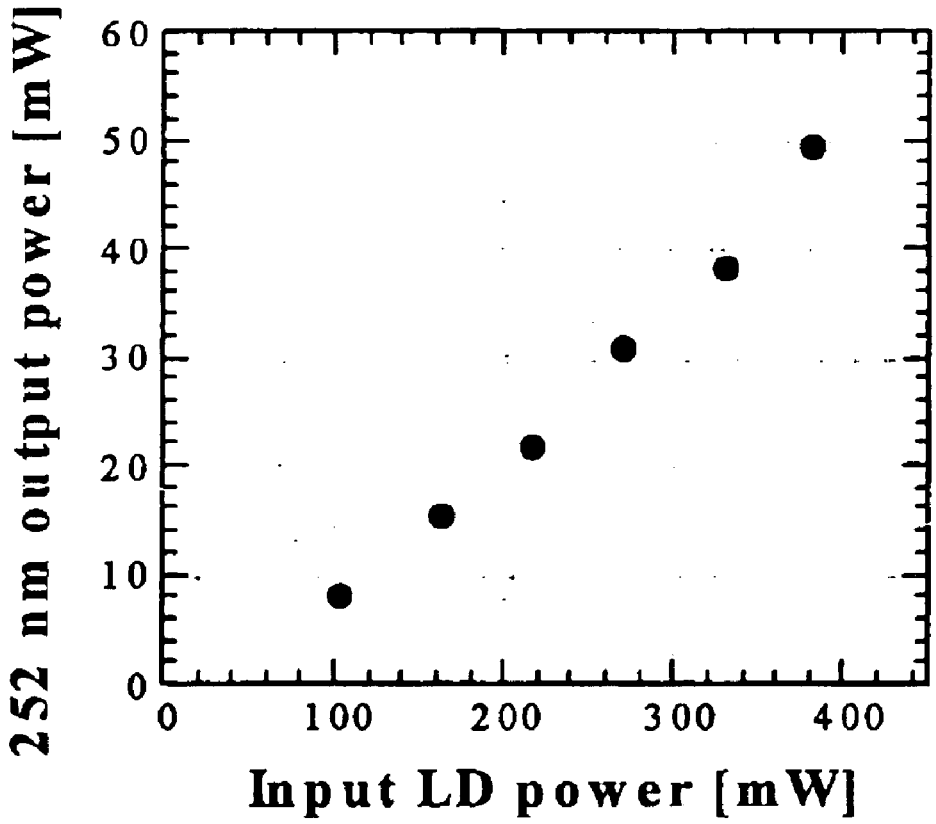
FIG. 17 is a graphical representation indicating input-output characteristics in sum-frequency generation in 252 nm wavelength of the coherent light source shown in FIG. 15 wherein input-output characteristics of output light having 252 nm wavelength with respect to input light having 780 nm wavelength in the case where input light having 373 nm wavelength is made to be constant at 480 mW are indicated.

In FIG. 17, an input power of the laser beam of 780 nm wavelength is plotted on the abscissa, and a measured value of output in the laser beam of 252 nm wavelength taken out from the resonator main body 2008 is plotted on the ordinate. In the case when the laser beam of 373 nm is 480 mW and the laser beam of 780 nm wavelength is 380 mW, 50 mW laser beam of 252 nm wavelength could be taken out from the resonator main body 2008. Judging from transmittances of the output mirror 2008-4 and the $\beta$-$BaB_2O_4$ crystal 2008-6, the laser beam of 252 nm wavelength generated has a value exceeding 60 mW, and a conversion efficiency of the sum frequency is estimated to be 7%. An enhancement factor was 92 with respect to the laser beam of 780 nm wavelength, while it was 34 with respect to the laser beam of 373 nm wavelength, and a loss in the whole resonators was 0.6% with respect to the laser beam of 780 nm, while it was 2.5% with respect to the laser beam of 373 nm. Taking these losses into consideration, a finesse of the resonator may be calculated as 241 with respect to the laser beam of 780 nm wavelength, while the finesse is 141 with respect to the laser beam of 373 nm wavelength.

When a line width is determined from a relationship between a free spectrum zone and finesse, it could be estimated to be 4.1 MHz with respect to the laser beam of 780 nm wavelength, while 7.1 MHz with respect to the light beam of 373 nm wavelength.

From the above-described results, a line width in the laser beam of 252 nm is estimated to be 12 MHz at the most, whereby it is found that the above value of the line width is within 29 MHz natural width in laser cooling transition of silicon atoms.

Furthermore, when a wavelength of the laser beam output from the single mode semiconductor laser 2002 changes from 780 nm to 785 nm and the optimum crystal angle is adjusted, tuning could be made within a wavelength range from 251 nm wavelength to 253 nm wavelength without an accompanying decrease in output of substantially 50 mW. A wide tuning range makes it possible to easily control silicon isotopes.

While the above-described embodiments of the present invention have been explained principally for cooling silicon atoms, the present invention is also applicable for other atoms as a matter of course.

In the following, an example of the invention, wherein a method, an apparatus, and a coherent light source according to the present invention are applied to germanium atoms, will be described.

First, an example of a preferred embodiment of a coherent light source used for laser cooling of germanium atoms will be described by referring to FIG. 18.

Figure 18:
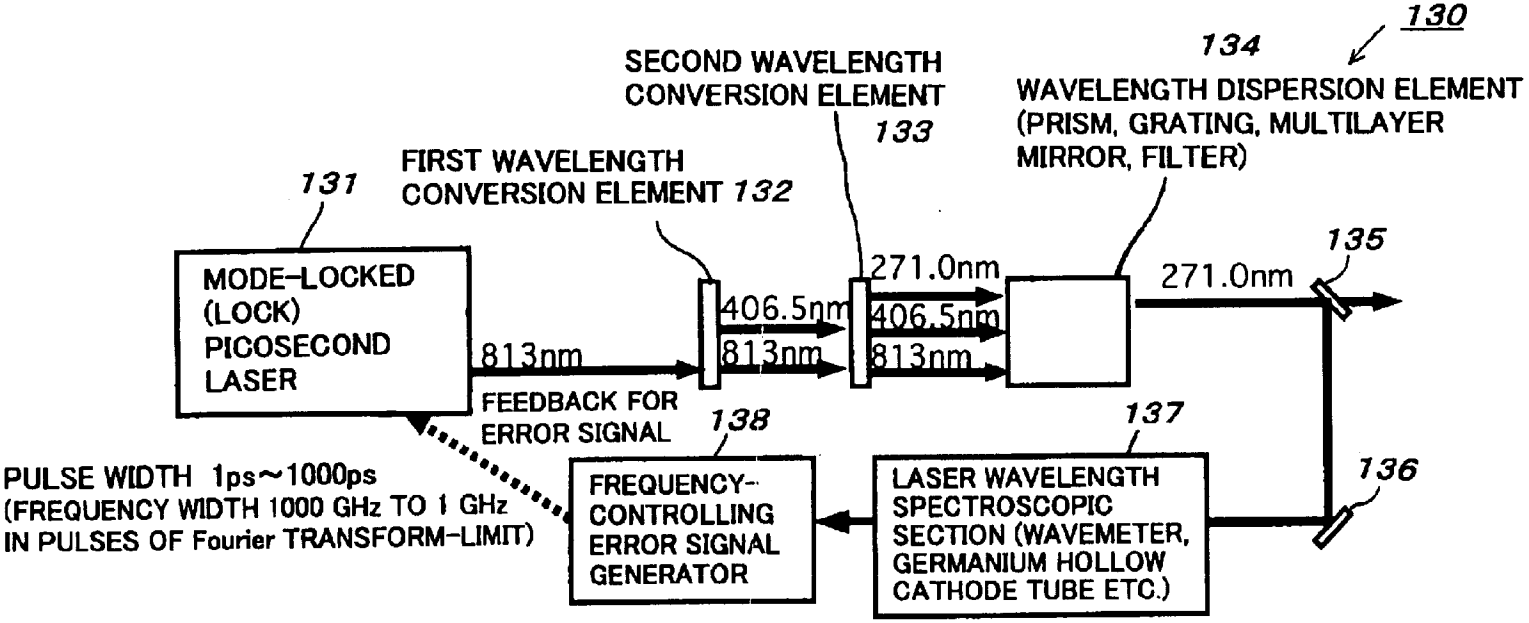
FIG. 18 is an explanatory diagram showing an example of a further preferred embodiment of a coherent light source used for laser cooling of atoms, and more particularly an explanatory diagram showing a constitution of a coherent light source used for laser cooling of atoms as a light source for decelerating germanium atoms by means of scattering force.

An example of the preferred embodiment of a coherent light source used for laser cooling of germanium atoms shown in FIG. 18 is a light source for decelerating germanium atoms by means of a scattering force (hereinafter referred to as a "picosecond coherent light source used for germanium deceleration"), and it may be used, for example, as the coherent light source section 52 in the laser cooling apparatus 50 of the present invention shown in FIG. 5. FIG. 18 shoes the first coherent light source section, the second coherent light source section, or the third coherent light source section in the laser cooling apparatus 80 according to the invention shown in FIG. 8(*a*); and the first coherent light source section or the second coherent light source section shown in FIG. 9(*a*), as a matter of course. Also, the above-described, light source may be used as a coherent light source in a laser cooling apparatus according to the present invention shown in FIG. 20, which will be described later.

A picosecond coherent light source used for germanium deceleration 130 shown in FIG. 18 is constituted so as to be capable of emitting coherent light of 271.0 nm wavelength, which includes a mode-locked (lock) picosecond laser 131, a first wavelength conversion element 132, a second wavelength conversion element 133, a wavelength dispersion element 134, a partial reflection mirror 135, a total reflection mirror 136, a laser wavelength spectroscopic section 137, and a frequency-controlling error signal generator 138. Further, a feedback loop for inputting an error signal to the mode-locked (lock) picosecond laser 131 as a feedback signal is composed of the partial reflection mirror 135, the total reflection mirror 136, the laser wavelength spectroscopic section 137, and the frequency-controlling error signal generator 138.

In this case, the mode-locked (lock) picosecond laser 131 outputs coherent light having a pulse width of from 1 ps to 1000 ps at 813 nm wavelength (a frequency zone of from 1000 GHz to 1 GHz in Fourier transform-limited pulse).

First, coherent light of 813 nm wavelength, output from the mode-locked (lock) picosecond laser 131, is input to the first wavelength conversion element 132, so that coherent light of 813 nm wavelength and coherent light being its second harmonic of 406.5 nm wavelength are obtained by means of the first wavelength conversion element 132.

Then, coherent light of 813 nm wavelength and coherent light of 406.5 nm wavelength output from the first wavelength conversion element 132 are input to the second wavelength conversion element 133, so that coherent light of 813 nm wavelength, coherent light being its second harmonic of 406.5 nm wavelength, and coherent light being its third harmonic of 271.0 nm wavelength are obtained by means of the second wavelength conversion element 133.

Moreover, when coherent light of 813 nm wavelength, coherent light of 406.5 nm wavelength, and coherent light of 271.0 nm wavelength output from the second wavelength conversion element 133 are input to the wavelength dispersion element 134, only coherent light of 271.0 nm wavelength is output from the wavelength dispersion element 134 to transmit to the partial reflection mirror 135, and the resulting light is used for deceleration of germanium atoms by means of a scattering force. In this case, the wavelength dispersion element 134 is prepared from, for example, a prism, a grating, a multilayer mirror, a filter or the like.

On one hand, coherent light having 271.0 nm wavelength reflected by the partial reflection mirror 135 is reflected by the total reflection mirror 136 to be input to the laser wavelength spectroscopic section 137 composed of a wavemeter, a silicon hollow cathode tube or the like.

A wavelength of the coherent light thus input is measured by the laser wavelength spectroscopic section 137, and the measured result is input to the frequency-controlling error signal generator 138.

The frequency-controlling error signal generator 138 feeds back an error signal on the basis of the measured result input such that the mode-locked (lock) picosecond laser 131 always produces coherent light having 813 nm wavelength.

As a result of such feedback control, it becomes possible to always emit coherent light of 271.0 nm wavelength to the germanium atoms.

Figure 19:
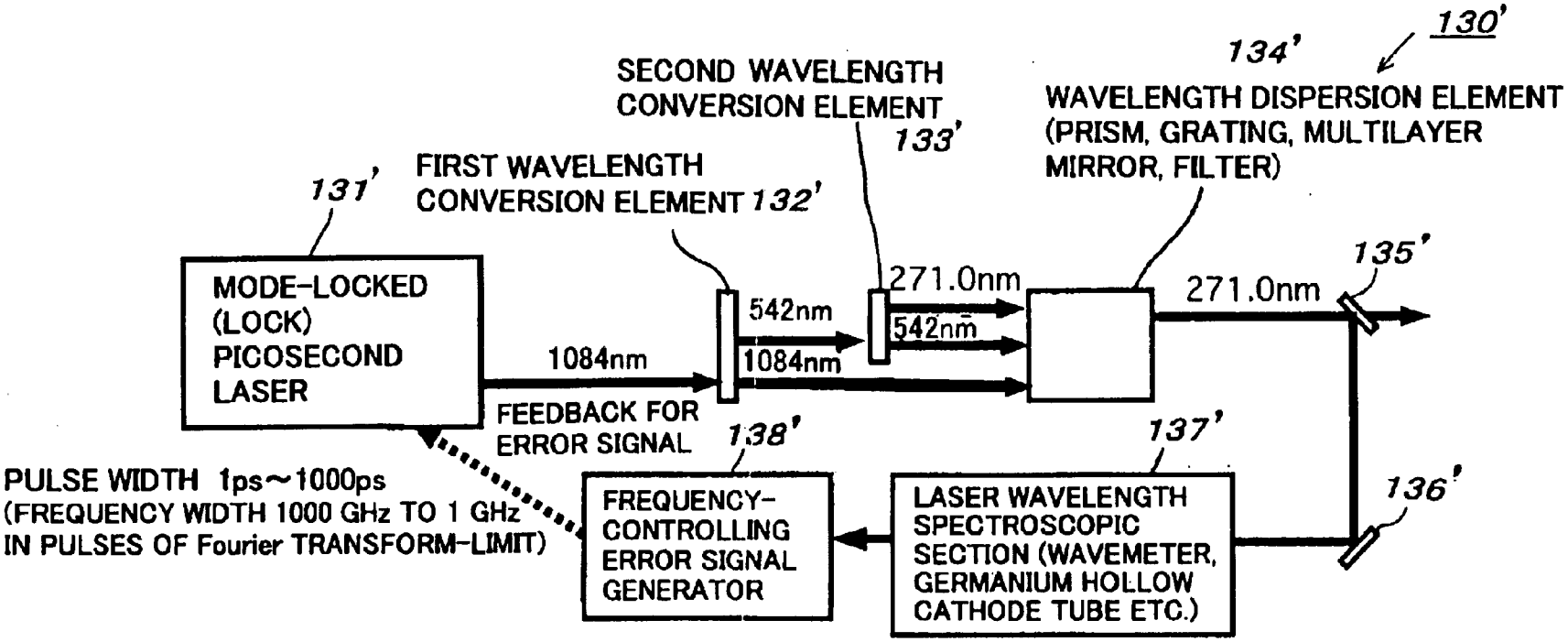
FIG. 19 is an explanatory diagram showing an example of still another preferred embodiment of a coherent light source used for laser cooling of atoms, and more particularly an explanatory diagram showing a coherent light source used for laser cooling of atoms as a light source for decelerating germanium atoms by means of scattering force.

FIG. 19 shows an example of another preferred embodiment of the picosecond coherent light source used for germanium deceleration 130 shown in FIG. 18 wherein the same or equivalent components of FIG. 18 are designated by the same reference numerals with a prime sign "'", and the detailed description therefor will be omitted.

A picosecond coherent light source used for germanium deceleration 130' shown in FIG. 19 is capable of emitting coherent light having 271.0 nm wavelength, which includes a mode-locked (lock) picosecond laser 131', a first wavelength conversion element 132', a second wavelength conversion element 133', a wavelength dispersion element 134', a partial reflection mirror 135', a total reflection mirror 136', a laser wavelength spectroscopic section 137', and a frequency-controlling error signal generator 138'. Further, a feedback loop for inputting an error signal to the mode-locked (lock) picosecond laser 131' as a feedback signal is composed of the partial reflection mirror 135', the total reflection mirror 136', the laser wavelength spectroscopic section 137', and the frequency-controlling error signal generator 138'.

In this case, the mode-locked (lock) picosecond laser 131' outputs coherent light having a pulse width of from 1 ps to 1000 ps at 1084 nm wavelength (a frequency zone of from 1000 GHz to 1 GHz in Fourier transform-limited pulse).

First coherent light of 1084 nm wavelength output from the mode-locked (lock) picosecond laser 131' is input to the first wavelength conversion element 132', so that coherent light of 1084 nm wavelength and coherent light being its second harmonic of 542 nm wavelength are obtained by means of the first wavelength conversion element 132'.

Then, coherent light of 542 nm wavelength output from the first wavelength conversion element 132' is input to the second wavelength conversion element 103', so that coherent light of 542 nm wavelength, and coherent light being its second harmonic of 271.0 nm wavelength are obtained by means of the second wavelength conversion element 133'.

Moreover, when coherent light of 542 nm wavelength and coherent light of 271.0 nm wavelength output from the second wavelength conversion element 133' as well as coherent light of 1084 nm wavelength output from the first wavelength conversion element 132' are input to the wavelength dispersion element 134', only coherent light of 271.0 nm wavelength is output from the wavelength dispersion element 134' to transmit to the partial reflection mirror 135', and the resulting light is used for deceleration of germanium atoms by means of a scattering force. In this case, the wavelength dispersion element 134' is prepared from, for example, a prism, a grating, a multilayer mirror, a filter or the like.

On one hand, coherent light having 271.0 nm wavelength reflected by the partial reflection mirror 135' is reflected by the total reflection mirror 136' to be input to the laser wavelength spectroscopic section 137' composed of a wavemeter, a silicon hollow cathode tube or the like.

A wavelength of the coherent light thus input is measured by the laser wavelength spectroscopic section 137', and the measured result is input to the frequency-controlling error signal generator 138'.

The frequency-controlling error signal generator 138' feeds back an error signal on the basis of the measured result input such that the mode-locked (lock) picosecond laser 131' always produces coherent light having 1084 nm wavelength.

As a result of such feedback control, it becomes possible to always emit coherent light of 271.0 nm wavelength to the germanium atoms.

In the following, an example of a preferred embodiment of a laser cooling apparatus according to the present invention wherein one picosecond coherent light source used for germanium deceleration 130 shown in FIG. 18 is used as a coherent light source for laser cooling of atoms (a picosecond coherent light source used for germanium deceleration to which polarized light control function has been added) will be described by referring to FIG. 20 wherein the same or equivalent components of FIG. 18 are designated by the same reference numerals used in FIG. 18, and the detailed description therefor is omitted.

On a laser cooling apparatus 140 according to the present invention, a first half-wavelength plate 141, a phase modulator 142, a second half-wavelength plate 143, a modulator driver 144, and a frequency converter 145 are mounted as a polarized light control section.

The frequency converter 145 outputs a control signal to the modulator driver 144 such that a modulating signal is output to the phase modulator 142 from the modulator driver 144 which is substantially twice the period of the spontaneous emission lifetime of a germanium atom, when a mode locking frequency is input to the frequency converter 145 and the mode locking frequency is subjected to frequency conversion. In other words, polarized light of coherent light output from the phase modulator 142 is switched in a period substantially twice longer than the spontaneous emission lifetime of the germanium atom.

More specifically, coherent light of 271.0 nm wavelength is controlled by the polarized light control section so as to be switched in a frequency substantially twice longer than the spontaneous emission lifetime of the germanium atom.

In the following, an example of another preferred embodiment of a laser cooling apparatus according to the present invention shown in FIG. 20 wherein one picosecond coherent light source used for germanium deceleration 130' shown in FIG. 19 is used as a coherent light source for laser cooling of atoms (a picosecond coherent light source used for germanium deceleration to which polarized light control function has been added) will be described by referring to FIG. 21 wherein the same or equivalent components of FIG. 19 are designated by the same reference numerals used in FIG. 19, and the same or equivalent components of FIG. 20 are designated by the same reference numerals with a prime sign "'", and the detailed description for these components will be omitted.

On a laser cooling apparatus 140' according to the present invention, a first half-wavelength plate 141', a phase modulator 142', a second half-wavelength plate 143', a modulator driver 144', and a frequency converter 145' are mounted to form a polarized light control section.

The frequency converter 145' outputs a control signal to the modulator driver 144' such that a modulating signal is output to the phase modulator 142' from the modulator driver 144' which has a period substantially twice the spontaneous emission lifetime of a germanium atom, when a mode locking frequency is input to the frequency converter 145' and the mode locking frequency is subjected to a frequency conversion. In otherwords, polarized light of the coherent light output from the phase modulator 112' is set to be switched in a period substantially twice longer than the spontaneous emission lifetime of germanium atom.

More specifically, coherent light of 271.0 nm wavelength is controlled by the polarized light control section so as to be switched in a frequency substantially twice longer than the spontaneous emission lifetime of the germanium atom.

Next, an example of a preferred embodiment of a laser cooling apparatus wherein a CW laser is used as a coherent light source utilized for laser cooling of atoms producing coherent light having a predetermined wavelength (a CW coherent light source used for germanium deceleration/cooling to which polarized light control function has been added) will be described by referring to FIG. 22.

In a laser cooling apparatus 150 according to the present invention shown in FIG. 22, one CW laser of 271 nm wavelength is specifically employed as the above-described CW laser.

The laser cooling apparatus 150 of the present invention can function to effect both deceleration by means of a scattering force and cooling by means of a scattering force with respect to germanium atoms.

Namely, the laser cooling apparatus 150 of the invention is provided with a CW laser 151 of 271 nm wavelength for germanium use as a coherent light source for laser cooling of atoms, and a polarized light control section including a first half-wavelength plate 152, a phase modulator 153, a second half-wavelength plate 154, a modulator driver 155, an oscillator 156, a first lens 157*a*, an acousto-optic device 158, a second lens 157*b*, and an acousto-optic device driver 159.

In the case where germanium atoms are decelerated by a scattering force, a frequency is changed time-varyingly by the use of the acousto-optic device 158 to implement chirped cooling.

On one hand, in the case where germanium atoms are cooled by a scattering force, the acousto-optic device 158 has an effect for separating time-varyingly polarized light and is convenient for optimizing a frequency.

There is a case that is effective for chirped cooling to install additionally an electro-optic shifter (EO shifter) between the CW laser for germanium use 151 and the first half-wavelength plate 152 to increase a frequency shift amount. Accordingly, such electro-optic shifter may optionally be disposed in the above-described position.

As the CW laser for germanium use 151 of 271 nm wavelength, for example, a fiber laser or fourth harmonic of a semiconductor laser of 1084 nm may be used, or second harmonic of a semiconductor laser of 542 nm wavelength or a semiconductor laser of 271 nm wavelength may be used.

While silicon atoms and germanium atoms have been described as objects to be cooled in the above-described embodiments, the invention is not limited thereto as a matter of course, but atoms of various elements can be processed as being objects to be cooled in accordance with the present invention.

More specifically, when a coherent light having a wavelength that is coincident with an atomic resonance line of wavelengths, or that is positively or negatively detuned wavelengths of a desired one among predetermined types of atoms constituting atoms to be handled, for example, various isotopes, is emitted to the atomic beam in question from a coherent light source device, the same functions and advantageous effects as those of the above-described embodiments can be obtained.

Since the present invention has been constituted as described above, there is an excellent advantage to provide a method for laser cooling of atoms in accordance with polarized light control by which laser cooling of a variety of atoms including semiconductor atoms such as silicon and germanium becomes possible, an apparatus therefor as well as a light source device used therein.

It will be appreciated by those of ordinary skill in the art that the present invention can be embodied in other specific forms without departing from the spirit or essential characteristics thereof.

The presently disclosed embodiments are therefore considered in all respects to be illustrative and not restrictive. The scope of the invention is indicated by the appended claims rather than the foregoing description, and all changes that come within the meaning and range of equivalents thereof are intended to be embraced therein.

The entire disclosure of Japanese Patent Application No. 2001-20243 filed on Jan. 29, 2001 and Japanese Patent Application No. 2002-11558 filed on Jan. 21, 2002 including specification, claims, drawing and summary are incorporated herein by reference in its entirety.

What is claimed is:

1. A method for laser cooling atoms each involving a plurality of magnetic sublevels as its cooling lower level being in a ground state in energy level, comprising:

emitting sequentially coherent light of a predetermined wavelength containing a plurality of differently polarized lights to the atoms in response to the plurality of magnetic sublevels being the cooling lower level in the ground state in an atom, which is an object to be laser-cooled, while keeping a predetermined time interval.

2. A method for laser cooling atoms as claimed in claim 1 wherein said predetermined time interval is substantially two times longer than a spontaneous emission lifetime of the atom corresponding to a time required for absorption—emission of one photon.

3. An apparatus for laser cooling atoms each involving a plurality of magnetic sublevels as its cooling lower level being in a ground state in energy level, comprising:

a coherent light source for producing a coherent light having a predetermined wavelength; and a polarized light control means for controlling polarized light of the coherent light output from said coherent light source to emit coherent light of different polarizations to the atom with a predetermined time interval;

wherein the polarized light of the coherent light emitted from said polarized light control means corresponds respectively to the plurality of differently polarized lights in response to the plurality of magnetic sublevels being the cooling lower level in the ground state of an atom, which is an object to be laser-cooled.

4. An apparatus for laser cooling atoms each involving a plurality of magnetic sublevels as its cooling lower level being in a ground state in energy level, comprising:

a plurality of coherent light sources outputting respectively a coherent light of a predetermined wavelength involving respectively a plurality of differently polarized lights in response to the plurality of magnetic sublevels being the cooling level in the ground state of an atom, which is an object to be cooled; and each coherent light having a predetermined wavelength and containing a plurality of differently polarized lights output from said plurality of coherent light sources being sequentially emitted to the atom while keeping a predetermined time interval;

wherein the polarized and of the coherent light emitted from said plurality of coherent light sources corresponds respectively to the plurality of differently polarized lights in response to the plurality of magnetic sublevels being the cooling lower level in the ground state of the atom, which is the object to be laser-cooled.

5. An apparatus for laser cooling atoms as claimed in claim 4 wherein:

at least one of said plurality of coherent light sources that outputs selectively coherent light involves two differently polarized lights.

6. An apparatus for laser cooling atoms as claimed in claim 3 wherein:

said predetermined time interval is substantially two times longer than a spontaneous emission lifetime of the atom corresponding to a time required for absorption—emission of one photon.

7. An apparatus for laser cooling atoms as claimed in claim 4 wherein:

said predetermined time interval is substantially two times longer than a spontaneous emission lifetime of the atom corresponding to a time required for absorption—emission of one photon.

8. An apparatus for laser cooling atoms as claimed in claim 5 wherein:

said predetermined time interval is substantially two times longer than a spontaneous emission lifetime of the atom corresponding to a time required for absorption—emission of one photon.

9. An apparatus for laser cooling atoms each involving a plurality of magnetic sublevels as its cooling lower level being in a ground state in energy level, comprising:

a coherent light source producing coherent light of predetermined wavelength;

a polarized light control means including a half-wavelength plate and an acousto-optic device, and controlling polarized light obtained from the coherent light output from said coherent light source by means of said half-wavelength plate to emit coherent light involving different polarized light to the atoms with a predetermined time interval; and chirped cooling being effected by changing time-varyingly a frequency by the use of said acousto-optic device to decelerate the atoms as well as to separate time-varyingly the polarized light obtained by means of said half-wavelength plate with the use of said acousto-optic device, in addition to optimizing the frequency, thereby cooling the atoms by means of a scattering force.

10. An apparatus for laser cooling atoms each involving a plurality of magnetic sublevels as its cooling lower level being in a ground state in energy level, comprising:

a coherent light source including a first laser beam producing system for producing a laser beam of a first wavelength, and a second laser beam producing system for producing a laser beam of a second wavelength as well as for receiving said laser beam of the first wavelength produced in said first laser beam producing system to produce a laser beam of a third wavelength as a result of a sum frequency mixing of the laser beam of said first wavelength and the laser beam of said second wavelength;

a polarized light control means including a half-wavelength plate and an acousto-optic device, and controlling polarized light obtained from the coherent light output from said coherent light source by means of said half-wavelength plate to emit coherent light involving different polarized light to the atoms with a predetermined time interval; and chirped cooling being effected by changing time-varyingly a frequency by the use of said acousto-optic device to decelerate the atoms as well as to separate time-varyingly the polarized light obtained by means of said half-wavelength plate with the use of said acousto-optic device, in addition to optimizing the frequency, thereby cooling the atoms by means of a scattering force.

* * * * *